US007360958B2

(12) United States Patent
Awano

(10) Patent No.: US 7,360,958 B2
(45) Date of Patent: Apr. 22, 2008

(54) SHEET PROCESSING APPARATUS

(75) Inventor: Hiroaki Awano, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/681,127

(22) Filed: Oct. 9, 2003

(65) Prior Publication Data

US 2004/0170462 A1 Sep. 2, 2004

(30) Foreign Application Priority Data

Feb. 27, 2003 (JP) ..... 2003-050438

(51) Int. Cl.
*B41J 11/00* (2006.01)

(52) U.S. Cl. ..... 400/621; 399/407; 270/58.07; 83/76.8

(58) Field of Classification Search ..... 83/73, 83/76, 76.1, 76.6, 76.7, 76.8; 400/621; 270/1.03, 270/5.02, 21.1; 271/58.07; 399/407
See application file for complete search history.

(56) References Cited

U.S. PATENT DOCUMENTS 3,780,607 A * 12/1973 Gerber ..... 83/49
RE30,757 E * 10/1981 Gerber ..... 83/74
5,802,974 A * 9/1998 McNeil ..... 101/226
5,823,692 A * 10/1998 Tolrud et al. ..... 400/582
5,836,224 A * 11/1998 Gerber ..... 83/22
7,137,625 B2 * 11/2006 Yamada et al. ..... 270/58.07

FOREIGN PATENT DOCUMENTS

| | | |
|---|---|---|
| JP | 9-123090 | 5/1997 |
| JP | 2000-103567 | 4/2000 |
| JP | 2000-143081 | 5/2000 |

* cited by examiner

*Primary Examiner*—Ren Yan
(74) *Attorney, Agent, or Firm*—Morgan, Lewis & Bockius LLP

(57) ABSTRACT

There are provided a sheet inlet, a saddle-stitch compilation tray for aligning and accommodating plural sheets that are input through the sheet inlet, and a rotary cutter unit for cutting a saddle-stitched sheaf of sheets accommodated in the saddle-stitch compilation tray. In the rotary cutter unit, a sheaf of sheets is cut by moving a circular blade in a direction perpendicular to a sheet transport direction of a sheet transport path from one end in the direction perpendicular to the sheet transport direction. Different sheaves of sheets may be cut by a go-movement and a return-movement of the circular blade.

6 Claims, 18 Drawing Sheets

FIG. 15

| NUMBER OF SHEETS | ORDINARY SHEET | THICK SHEET-1 | THICK SHEET-2 |
|---|---|---|---|
| 2 | HIGH SPEED (- 512gsm) | HIGH SPEED (- 648gsm) | HIGH SPEED (- 880gsm) |
| 3 | HIGH SPEED (- 768gsm) | HIGH SPEED (- 972gsm) | MIDDLE SPEED (- 1320gsm) |
| 4 | HIGH SPEED (- 1024gsm) | MIDDLE SPEED (- 1296gsm) | MIDDLE SPEED (- 1760gsm) |
| 5 | HIGH SPEED (- 1280gsm) | MIDDLE SPEED (- 1620gsm) | MIDDLE SPEED (- 2200gsm) |
| 6 | MIDDLE SPEED (- 1536gsm) | MIDDLE SPEED (- 1944gsm) | LOW SPEED (- 2640gsm) |
| 7 | MIDDLE SPEED (- 1792gsm) | MIDDLE SPEED (- 2268gsm) | LOW SPEED (- 3080gsm) |
| 8 | MIDDLE SPEED (- 2048gsm) | LOW SPEED (- 2592gsm) | LOW SPEED (- 3520gsm) |
| 9 | MIDDLE SPEED (- 2304gsm) | LOW SPEED (- 2916gsm) | BOOK FORMATION IMPOSSIBLE |
| 10 | MIDDLE SPEED (- 2560gsm) | LOW SPEED (- 3240gsm) | BOOK FORMATION IMPOSSIBLE |
| 11 | LOW SPEED (- 2816gsm) | LOW SPEED (- 3564gsm) | BOOK FORMATION IMPOSSIBLE |
| 12 | LOW SPEED (- 3072gsm) | BOOK FORMATION IMPOSSIBLE | BOOK FORMATION IMPOSSIBLE |
| 13 | LOW SPEED (- 3328gsm) | BOOK FORMATION IMPOSSIBLE | BOOK FORMATION IMPOSSIBLE |
| 14 | LOW SPEED (- 3584gsm) | BOOK FORMATION IMPOSSIBLE | BOOK FORMATION IMPOSSIBLE |
| 15 | LOW SPEED (- 3840gsm) | BOOK FORMATION IMPOSSIBLE | BOOK FORMATION IMPOSSIBLE |

SHEET PROCESSING APPARATUS

BACKGROUND OF THE INVENTION

1. Field of the Invention

The present invention relates to a sheet processing apparatus for processing sheets that are ejected from an image forming apparatus such as a printer or a copier. More specifically, the invention relates to a sheet processing apparatus having a sheet cutting mechanism.

2. Description of the Related Art

A number of proposals have been made conventionally about post-processing apparatus for binding a book using recorded sheets that are ejected from an image forming apparatus such as a printer or a copier and outputting the resulting book. Among those is a sheet post-processing apparatus that staples, on the center line, sheets that have been ejected from an image forming apparatus and are stacked, folds the sheets in half along the stapling line (saddle stitch), presses the folded sheets and cuts of their end portions, and outputs a resulting book.

FIG. 18 illustrates a conventional sheet post-processing apparatus. In the sheet post-processing apparatus 201 that is connected to an image forming apparatus 200, a sheet that is ejected from sheet ejection rollers 230 of the image forming apparatus 200 is accepted by inlet rollers 202 and then transported along a transport path 220 by transport rollers 203. The sheet is then moved through a U-turn transport path in which the transport path is extremely bend by using a turn roller 204 and a switching nail 205, and put into a stacker 206. A sheaf of sheets is thus stacked in the stacker 206. The stacked sheaf of sheets is positioned in its width direction by a positioning stopper 208 that can be moved up and down by rotation of a belt 207, and the sheaf of sheets is then stapled on the center line by a stapler 210. Subsequently, the positioning stopper 108 is moved upward, whereby the center line reaches the position of a folding blade 211.

A folding operation is as follows. Upon turning-on of a solenoid 216, the folding blade 211 is moved downward obliquely, whereby the sheaf of sheets is pressed against the sheaf-of-sheets ejection outlet 209 and starts to be folded. The folded sheaf of sheets is nipped between pre-press rollers 212 and further transported downstream. After the fold is made sharper by a press rollers 214, the sheaf of sheets is transported to a cutting position of a slide cutting device 213 and stopped there. A cutting blade of the slide cutting device 213 is moved downward, whereby end portions of the folded sheets are cut off in a guillotine-like manner with the cutting blade and a fixed blade. Resulting saddle-stitch books are stacked on a sheet ejection tray 215.

In connection with the above mechanisms, a technique is known in which a cutting portion is positioned in a state that a sheaf of sheets to be cut is nipped between the press rollers 214 and the sheaf of sheets is cut by lowering a sharp cutting blade of the slide cutting device 213, whereby a resulting saddle-stitch book is given a clear, accurate edge (e.g., refer to JP-A-2000-143081 (pages 5 and 6 and FIG. 1)). Another technique is known in which end portions of stapled and folded sheets are cut off by a sheet cutting unit such as the slide cutting device 213 in a state that the sheets bridge the sheet cutting unit and a sheet stacking unit such as the sheet ejection tray 215, whereby the installation area of the apparatus can be reduced by a sheet projection length (e.g., refer to JP-A-2000-103567 (pages 3 and 4 and FIG. 1).

Incidentally, in recent years, it has come to be desired that equipment be reduced in size and from the viewpoint of ecology it has come to be desired strongly that equipment be reduced in power consumption. This trend also applies to post-processing apparatus for image processing apparatus. The techniques of the above-mentioned patent documents employ the guillotine-type slide cutting device is used, which is superior in that the cutting operation is quick. However, because of the guillotine-type, a long stroke is needed for the cutting blade, as a result of which the apparatus is voluminous as a whole. Further, the cutting blade should cover the entire sheet width and hence is costly. Further, instantaneous cutting causes a high degree of load concentration, which requires a very large drive current and starting current. This is a problem that should be solved from the viewpoint of ecology. Still further, since the cutting device itself is large, the degree of freedom in determining its position in the apparatus is low; for example, the ejection outlet should be located low in the apparatus. It was difficult to provide sheet processing apparatus that are easy-to-use to users.

In view of the above, inventors developed and proposed a technique in which a cutter unit for cutting a sheaf of sheets by moving a rotating circular blade in a horizontal direction is provided in the main body of a sheet processing apparatus (Japanese Patent Application No. 2002-364918). Employment of this technique makes it possible to provide a sheet processing apparatus that is smaller in size and maximum power than in the case of using the conventional technique. The inventors have thereafter studied diligently and improved the this technique in terms of power consumption and ease of use to users while maintaining the cutting quality. The present application is to propose such technical items that were not described in the previous application.

SUMMARY OF THE INVENTION

The present invention has been made in view of the above circumstances, and provides a sheet processing apparatus having a sheet cutting function and being low in power consumption.

The invention also provides a sheet processing apparatus that is increased in ease of use to users.

The invention further provides a sheet processing apparatus that provides cutting quality and speed that are suitable for a situation of its use.

In terms of configuration, in the invention, a cutter unit for cutting a sheaf of sheets by, for example, moving a circular blade parallel with sheet surfaces while rotating it is provided inside the main body of a sheet processing apparatus. The cutter unit determines circular blade movement conditions on the basis of various kinds of information such as the number and the kind of sheets that constitute a sheaf. That is, according to one aspect of the invention, a sheet processing apparatus for processing sheets on which images have been formed by an image forming apparatus, comprises sheet accepting unit for accepting sheets from the image forming apparatus; cutting unit for cutting the sheets accepted by the sheet accepting unit with a blade that is moved parallel with sheet surfaces; and recognizing unit for recognizing information relating to the sheets to be cut by the cutting unit, wherein the cutting unit determines a condition of cutting of the sheets on the basis of the information relating the sheets that has been recognized by the recognizing unit.

The cutting condition that is determined by the cutting unit may be a movement condition of the blade that is moved parallel with the sheet surfaces. The movement condition may be a moving speed of the blade that is moved parallel with the sheet surfaces. The movement condition may also be a movement range of the blade that is moved parallel with the sheet surfaces. For example, the movement range may be determined by a movement start position and/or a movement stop position of the blade that is moved parallel with the sheet surfaces.

The recognizing unit may recognize the number and/or a kind of sheets to be cut in the form of a sheaf. The recognizing unit may also recognize a registration method of the sheets on which the images have been formed by the image forming apparatus. Examples of the sheet registration method are what is called center registration and side registration.

According to another aspect of the invention, a sheet processing apparatus comprises sheet accepting unit for accepting sheets that are output from the image forming apparatus; a sheaf-of-sheets forming unit for forming a sheaf of sheets by aligning the plural sheets accepted by the sheet accepting unit; and cutting unit for cutting the sheaf of sheets formed by the sheaf-of-sheets forming unit, wherein the cutting unit cuts the sheaf of sheets under a cutting condition that is determined on the basis of a power state of the sheet processing apparatus and/or the image forming apparatus. The cutting unit may comprise a circular blade that is moved parallel with sheet surfaces while being rotated and a fixed blade that is opposed to the circular blade and has a blade edge extending parallel with the sheet surfaces, and the cutting unit may determine a movement condition of the circular blade on the basis of the power state. The cutting unit may set a cutting speed lower when a sufficient amount of power is not available than when a sufficient amount of power is available.

According to another aspect of the invention, a sheet processing apparatus comprises recognizing unit for recognizing a request from a user that relates to cutting quality of the cutting unit, such as an instruction that is input by the user through an operating panel, wherein the cutting unit sets a low operation speed for cutting when the recognizing unit recognizes occurrence of a quality priority request.

According to still another aspect of the invention, a sheet processing apparatus comprises cutting unit that reciprocates a blade from a prescribed position in such a manner as to cut the sheaf of sheets by a go-movement and to return the blade to the prescribed position by a return movement, and that waits for input of a next sheaf of sheets in a state that the blade is returned to the prescribed position. The cutting unit sets different moving speeds of the blade for the go-movement and the return movement. The cutting unit may comprise a circular blade that is moved parallel with sheet surfaces while being rotated, and may set a moving speed of the circular blade for the go-movement lower than that for the return-movement.

According to yet another aspect of the invention, a sheet processing apparatus comprise a sheet inlet; a compilation tray for accommodating, in a flushed manner, the plural sheets that are input through the sheet inlet; and a cutter unit for cutting a saddle-stitched sheaf of sheets that is accommodated in the compilation tray by moving a blade in a direction perpendicular to a sheet transport direction on a sheet transport path from one end in the direction perpendicular to the sheet transport direction in such a manner as to cut different sheaves of sheets by a go-movement and a return-movement of the blade. The cutter unit may comprise a circular blade that is moved in a horizontal direction and a fixed blade that is opposed to the circular blade and extending in the horizontal direction, and the cutter unit may cut a saddle-stitched sheaf of sheets by moving the circular blade parallel with the fixed blade while rotating the circular blade in such a manner as to cut one sheaf of sheets by a go-movement of the circular blade, wait for input of a next sheaf of sheets with the circular blade located at an end position, and cut the next sheaf of sheets by starting a return-movement of the circular blade after completion of input of the next sheaf of sheets.

According to a further aspect of the invention, a sheet processing apparatus which binds the plural sheets that are output from an image forming apparatus and performs a cutting operation on a resulting sheaf of sheets using a prescribed cutter, comprises moving speed determining unit for determining a moving speed of the cutter; movement position determining unit for determining a movement start position and/or a movement stop position of the cutter; processing time calculating unit for calculating a processing time of the cutting operation on the basis of the moving speed determined by the moving speed determining unit, the movement start position and/or the movement stop position determined by the moving position determining unit, and other information; output unit for outputting the processing time calculated by the processing time calculating unit to the image forming apparatus; and operating panel control unit for causing an operating panel to output a prescribed message on the basis of the processing time calculated by the processing time calculating unit. The moving speed determining unit may determine a moving speed on the basis of a power state of the sheet processing apparatus and/or the image forming apparatus. The moving speed determining unit may also determine a moving speed on the basis of information relating to the sheaf of sheets to be cut.

BRIEF DESCRIPTION OF THE DRAWINGS

Preferred embodiment of the present invention will be described in detail based on the following figures, wherein:

FIG. 15 shows a relationship between the cutter moving speed and the combination of the number and the kind of sheets in a case that a power upper limit is set;

DESCRIPTION OF THE PREFERRED EMBODIMENT

An embodiment of the present invention will be hereinafter described with reference to the accompanying drawings.

Figure 1:
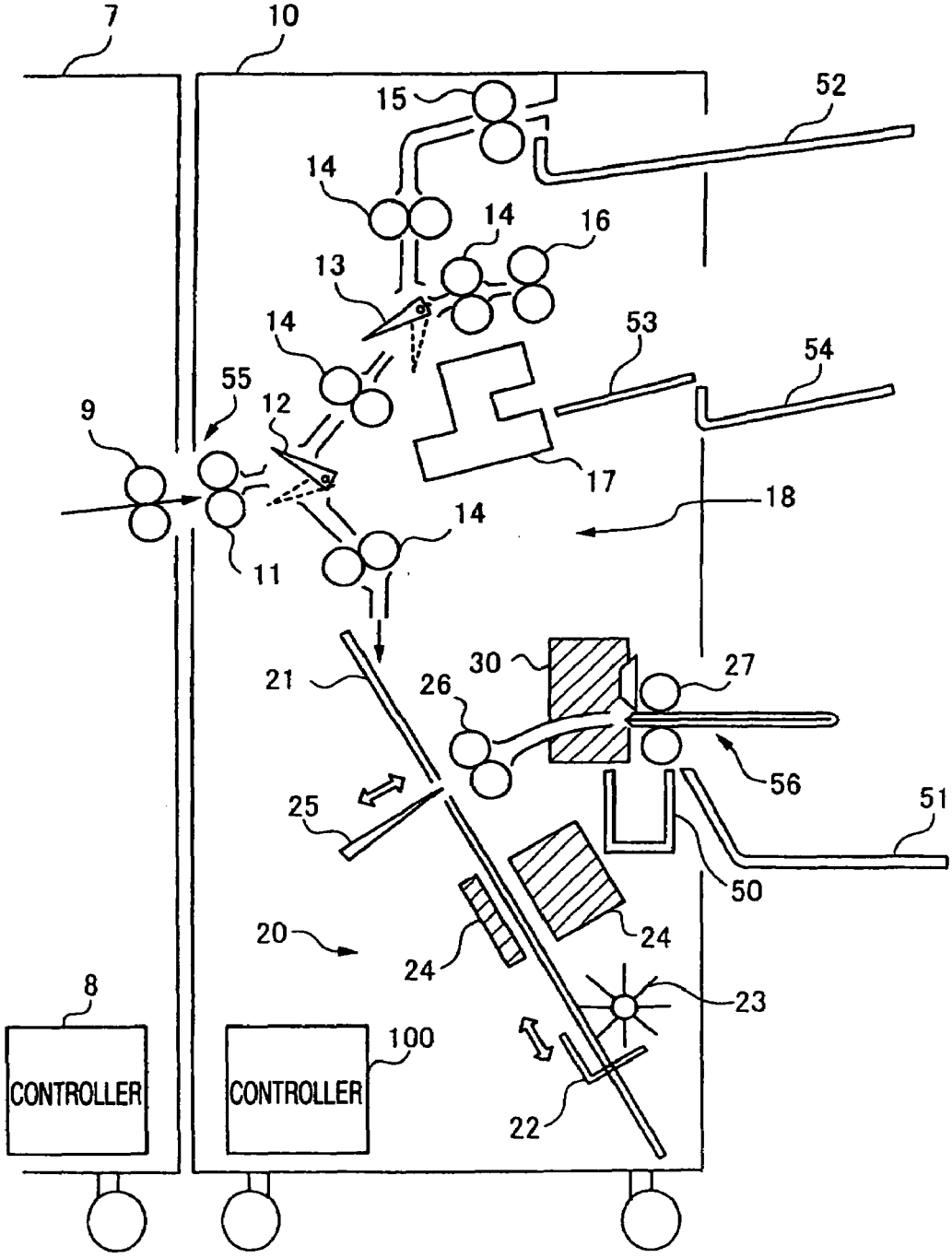
FIG. 1 shows the entire configuration of a sheet processing apparatus according to an embodiment of the present invention.

FIG. 1 shows the entire configuration of a sheet processing apparatus according to the embodiment. The sheet processing apparatus 10 is connected to an image forming apparatus 7 such as a printer or a copier that forms a color image by electrophotography, for example, and used as a post-processing apparatus. The sheet processing apparatus 10 is equipped with not only an output section that performs no post-processing and an output section for forming an end-stapled book but also a booklet forming section 20 for forming a bound booklet.

As shown in FIG. 1, the sheet processing apparatus 10 is equipped with a sheet inlet 55 for receiving a printed sheet that is output from ejection rollers 9 of the image forming apparatus 7; inlet rollers 11 that are a pair of rollers that are disposed in the vicinity of the sheet inlet 55 and receives a sheet; a first gate 12 for selectively supplying a sheet that has been input through the inlet rollers 11 to the booklet forming section 20, the ordinary output section or the end-stapled book output section; a second gate 13 for selectively supplying a transported sheet to the output section that performs no post-processing or the end-stapled book output section; transport rollers 14 that are pairs of rollers that are disposed on sheet transport paths and transport a sheet to each section; first ejection rollers 15 that are a pair of rollers for ejecting a sheet as the output section that performs no post-processing; a tray 52 for accumulating sheets that are ejected from the first ejection roller 15; second ejection rollers 16 that are a pair of rollers for ejecting a sheet for end stapling; an end-stapling compilation tray 53 for accumulating sheets for end stapling; an end-stapling stapler 17 for stapling sheets that are accumulated on the end-stapling compilation tray 53; and an end-stapled book tray 54 for accumulating end-stapled books.

The booklet forming section 20 is equipped with a saddle-stitch compilation tray 21 for accumulating a necessary number of image-formed sheets to form a booklet; a positioning stopper 22 that has a positioning portion projecting to above the saddle-stitch compilation tray 21 and that is moved parallel with the saddle-stitch compilation tray 21 to determine a saddle-stitch portion or a folding portion; a sheets aligning member 23 that is a paddle wheel that is rotated to move sheets accumulated on the saddle-stitch compilation tray 21 toward the positioning stopper 22 to flush those; and a saddle-stitch stapler 24 for saddle-stitching sheets accumulated on the saddle-stitch compilation tray 21.

The booklet forming section 20 is also equipped with a folding knife 25 that is moved so as to project from below the saddle-stitch compilation tray 21 to above it to fold a sheaf of sheets that has been saddle-stitched by the saddle-stitch stapler 24 along the saddle-stitch line; first folding rollers 26 that are a pair of rollers for nipping a sheaf of sheets for which folding by the folding knife 25 has started; second folding rollers 27 that are a pair of rollers sharpening the fold of a sheaf of sheets being transported by the first folding rollers 26 and for fixing the sheaf of sheets during cutting; a rotary cutter unit 30 for cutting a sheaf of sheets nipped between the second folding rollers 27 while being moved parallel with the sheet surfaces (in a horizontal direction that is perpendicular to the sheet transport direction; e.g., in a direction from the IN-side (deep side) to the OUT-side (viewer's side) or the direction opposite to it); a cutting waste paper box 50 for storing cutting waste paper that has been produced by the rotary cutter unit 30; a saddle-stitch sheet ejection outlet 56 as an opening through which to output produced saddle-stitch sheets from the main body; and a book tray 51 that is disposed close to the saddle-stitch sheet ejection outlet 56 and on which books produced by cutting by the rotary cutter unit 30 are stacked. The sheet processing apparatus 10 is further equipped with a controller 100 for controlling the entire sheet processing apparatus 10. The controller 100 exchanges information with a controller 8 of the image forming apparatus 7 (inter-apparatus information exchange). The sheet processing apparatus 10 may be controlled by the controller 8 of the image forming apparatus 7 instead of using the controller 100.

Where a conventional guillotine-type (i.e., slide-type) cutter is employed, a long stroke for cutting is needed and the cutting unit occupies a wide space. In contrast, in the embodiment which employs the rotary cutter unit 30 as the cutting unit, the cutting direction can be set parallel with sheet surfaces; for example, it is set to a direction from the IN-side (deep side) to the OUT-side (viewer's side) or the direction opposite to it. This makes it possible to accommodate the rotary cutter unit 30 in the space that is occupied by the saddle-stitch compilation tray 21 and is determined by a sheet length, to thereby prevent size increase of the apparatus 10.

Next, the operation of the sheet processing apparatus 10 shown in FIG. 1 will be described. A printed (recorded) sheet that is ejected from the ejection rollers 9 of the image forming apparatus 7 enters the main body of the sheet processing apparatus 10 through the sheet inlet 55, is transported by the inlet rollers 11, and is supplied to the booklet forming section 20 or the other processing sections by a switching operation of the first gate 12 that is controlled by the controller 100. For mere sheet ejection or formation of an end-stapled book, the first gate 12 is turned downward (counterclockwise; indicated by a broken line in FIG. 1), whereby the sheet is pushed up and then transported upward by the transport rollers 14. In the case of simple ejection, the second gate 13 is turned downward (counterclockwise; indicated by a broken line in FIG. 1), whereby the sheet passes the transport rollers 14 and is ejected from the first ejection rollers 15 to the tray 52. In the case of formation of an end-stapled book, the second gate 13 is turned upward (clockwise; indicated by a solid line in FIG. 1), whereby the sheet passes the transport rollers 14 and is ejected from the second ejection rollers 16 to the end-stapling compilation tray 53. Subsequently, a sheaf of sheets is stapled at end positions by the end-stapling stapler 17 and ejected from the end-stapling sheet ejection outlet to the end-stapled book tray 54.

On the other hand, in the case of formation of a saddle-stitch booklet, on the basis of instructions from the controller 100, the first gate 12 is turned upward (clockwise; indicated by a solid line in FIG. 1), whereby the sheet is pushed down, passes the transport rollers 14, and is put on the saddle-stitch compilation tray 21. For example, a preset number (e.g., 5, 10, or 15; set by, for example, the controller 8 of the image forming apparatus 7) of sheets are accumulated on the saddle-stitch compilation tray 21. In this state, the positioning stopper 22 has been moved by a mechanism to be described later so that its center line goes to a stapling position of the saddle-stitch stapler 24 and is stopped there. Further, in this state, the sheets aligning member 23 is rotated counterclockwise so that the accumulated sheets are pressed against the positioning stopper 22, to thereby assist aligning of the sheets.

When the prescribed number of sheets have been accumulated on the saddle-stitch compilation tray 21, the sheets are saddle-stitched by the saddle-stitch stapler 24 at a prescribed position (e.g., at the center) of the sheets. The sheaf of saddle-stitched sheets is moved by an upward movement of the positioning stopper 22 so that a folding portion (e.g., the center of the sheets) coincides with the edge position of the folding knife 25. During the accumulation of sheets on the saddle-stitch compilation tray 21, the saddle stitching by the saddle-stitch stapler 24, and the transport of the sheets after the saddle-stitching, the edge of the folding knife 25 is in escape under the saddle-stitch compilation tray 21 and does not project from the surface of the saddle-stitch compilation tray 21.

After the folding portion of the sheaf of sheets has been moved to the edge position of the folding knife 25, the folding knife 25 is pushed up perpendicularly to the accommodation surface of the saddle-stitch compilation tray 21 by a mechanism to be described later and its edge touches the sheaf of sheets. The edge of folding knife 25 is further pushed up, whereby the sheaf of sheets is lifted and nipped between the first folding rollers 26. The folding knife 25 is configured so as to allow the sheaf of sheets to be moved to such a position that a sufficiently long part of the sheaf of sheets passes the first folding rollers 26. The sheaf of sheets that has been given a first-stage folding portion is transported to the second folding rollers 27, by which the sheaf of sheets is pressed and thereby folded sufficiently. The folding is completed by the sheets' passing the second folding rollers 27.

The second folding rollers 27 are in a temporary halt at the instant of reception of the sheaf of sheets from the first folding rollers 26. The second folding rollers 27 start to rotate with such timing that the sheaf of sheets is expected to be sufficiently engaged with the second folding rollers 27, and a feed length of the sheaf of sheets is determined. A cutting-desired portion, corresponding to a desired final size of a book, of the sheaf of sheets is moved to the cutting position of the rotary cutter unit 30 by the second folding rollers 27, and the second folding rollers 27 are stopped, whereupon the sheaf of sheets is fixed by the second folding rollers 27. Then, the circular blade of the rotary cutter unit 30 is moved in the horizontal direction, whereby end portions of the sheets are cut off and put into the cutting waste paper box 50. Subsequently, the second folding rollers 27 are rotated again, whereby the cut sheaf of sheets as a bound book is output from the saddle-stitch sheet ejection outlet 56 to the book tray 51.

Figure 2:
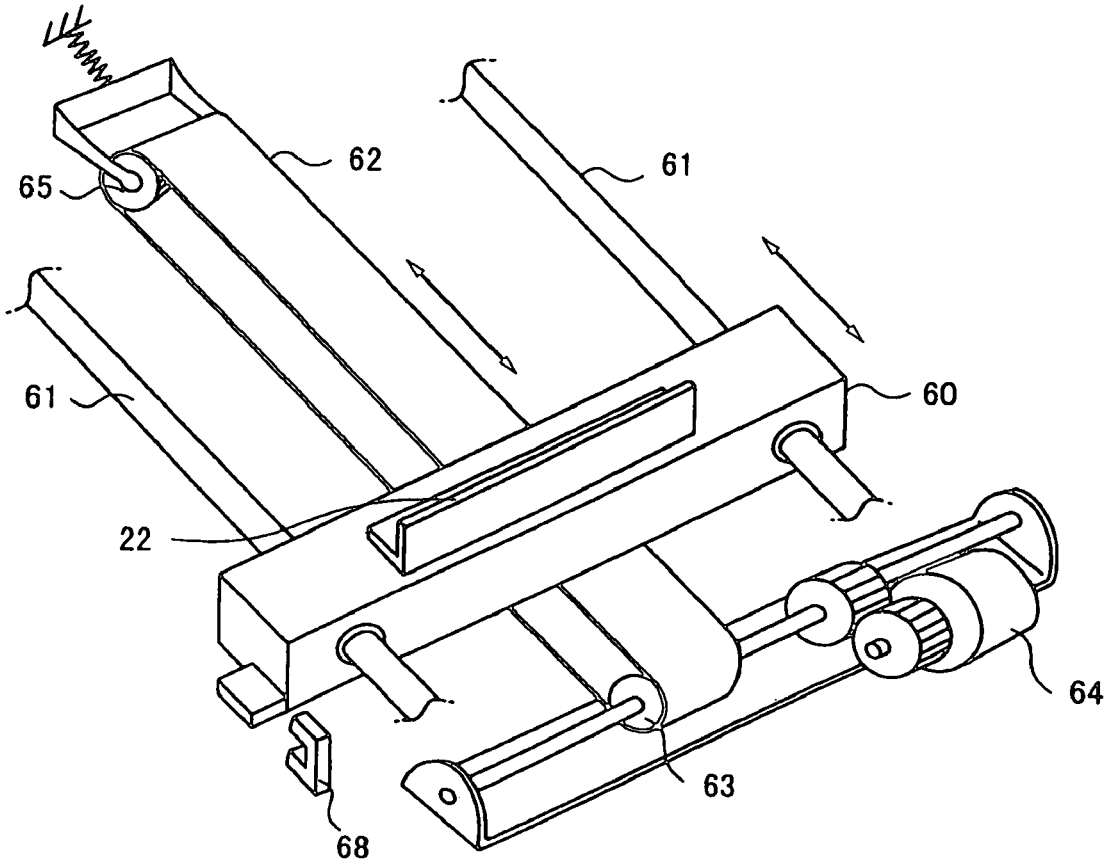
FIG. 2 illustrates a mechanism for operating a positioning stopper.

FIG. 2 illustrates a mechanism for operating the positioning stopper 22. This mechanism is equipped with a carriage 60 on which the positioning stopper 22 is fixed; a guide shaft 61 for guiding a movement of the carriage 60 by allowing the carriage 60 to slide; a belt 62 that is connected to the carriage 60 and rotates to cause the carriage 60 to slide; a drive roller 63 for driving the belt 62; a motor 64 that is a driving source of the drive roller 63 and performs normal rotation and reverse rotation repeatedly; a tension roller 65 for giving constant tension to the belt 62; and a home position sensor 68 as a sensor for determining an initial position of the carriage 60.

From a state that the carriage 60 is positioned by using the home position sensor 68, the motor 64 starts to rotate under the control of the controller 100 (see FIG. 1). Drive force is transmitted from the motor 64 to the drive roller 63 via gears, whereby the drive roller 63 is rotated clockwise and counterclockwise. As a result, the belt 62 is rotated in one or the other direction, whereby the carriage 60 is moved being guided by the guide shaft 61. As the carriage 60 is so moved, the positioning stopper 22 is reciprocated parallel with the saddle-stitch compilation tray 21. The positioning stopper 22 is stopped at, for example, the prescribed position that is preset as the home position. In this state, sheets that are input through the sheet inlet 55 are positioned at the saddle-stitch position of the saddle-stitch stapler 24. Then, the motor 64 is rotated so that the center, that is, the saddle-stitch portion, of the saddle-stitched sheaf of sheets is positioned at the folding position of the folding knife 25; the positioning stopper 22 is moved by a prescribed distance and then stopped. In the above-described manner, sheets that have been accumulated on the saddle-stitch compilation tray 21 are positioned at the saddle-stitch position and then at the folding position.

Figure 3A:
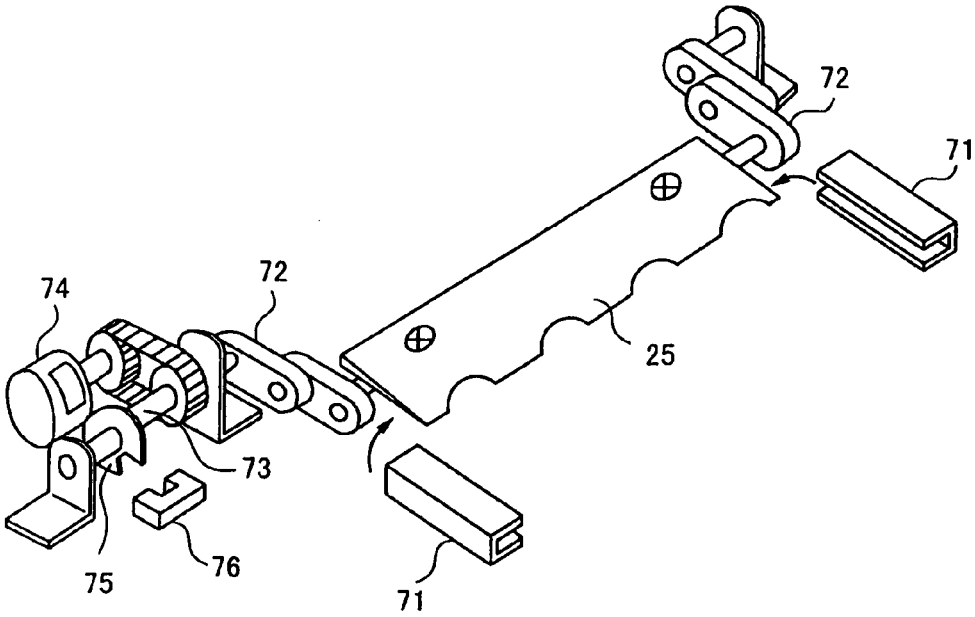
FIGS. 3A and 3B illustrate a mechanism for operating a folding knife.
Figure 3B:
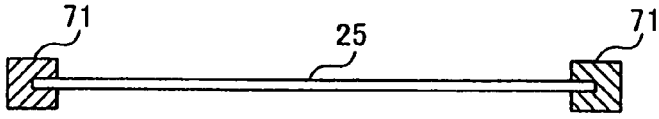

FIGS. 3A and 3B illustrate a mechanism for operating the folding knife 25. As shown in FIG. 3A, this mechanism is equipped with guides 71 that are disposed on both sides the folding knife 25 and guide the folding knife 25 when it advances (i.e., projects) or retreats; cranks 72 that are disposed on both sides the folding knife 25 and cause the folding knife 25 to project or retreat; a crank rotating shaft 73 for rotating the cranks 72; a motor 74 as a driving source for giving drive force to the crank rotating shaft 73; an encoder 75 that is attached to the crank rotating shaft 73 and serves to control an advance/retreat position of the folding knife 25; and a sensor 76 for sending the controller 100 output information of the encoder 75 to control the movement of the motor 74. As shown in FIG. 3B, since the two ends of the folding knife 25 are held by the respective guides 71, the folding knife 25 can advance and retreat smoothly.

Figure 4A:
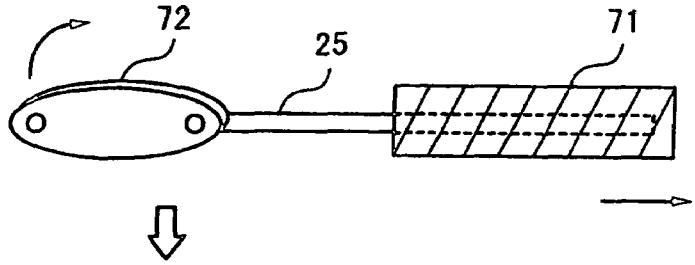
FIGS. 4A-4E illustrate how the folding knife advances and retreats.
Figure 4B:
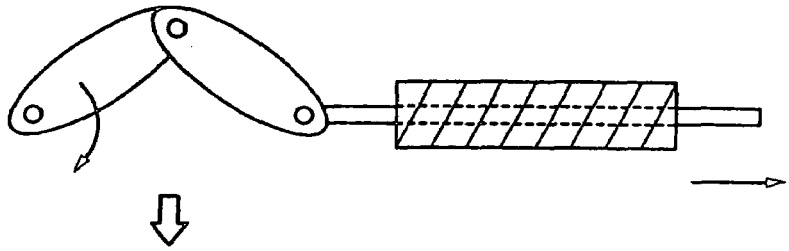
Figure 4C:
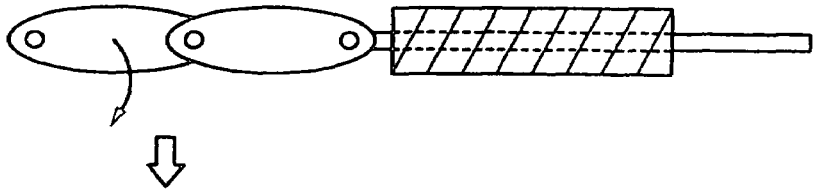
Figure 4D:
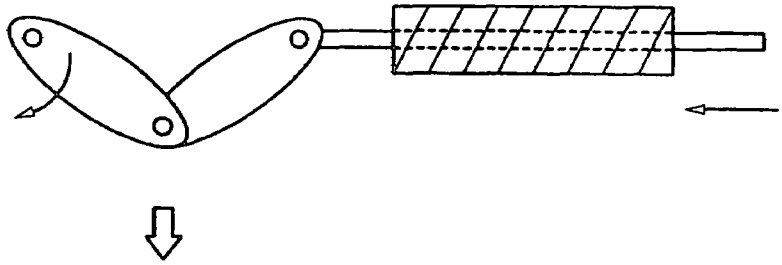
Figure 4E:
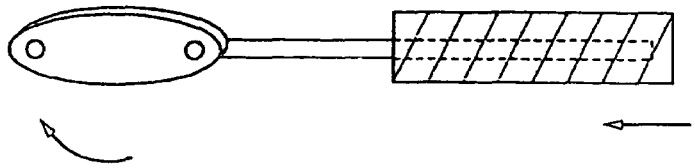

FIGS. 4A-4E illustrate how the folding knife 25 advances and retreats. FIG. 4A shows a standby state that the folding knife 25 is retreated from the saddle-stitch compilation tray 21. The folding knife 25 does not obstruct accumulation of sheets on the saddle-stitch compilation tray 21. After printed sheets have been accumulated in such a number as to be necessary to form a book, they are saddle-stitched by the saddle-stitch stapler 24 and then the folding portion (e.g., the center) of the sheets is positioned at the position of the folding knife 25 by the positioning stopper 22. After completion of the positioning, operation of the motor 74 is started on the basis of a signal from the controller 100, whereby the crank shaft 73 and hence the cranks 72 are rotated. Because of the rotation of the cranks 72, the folding knife 25, being guided by the guides 71, is moved in such a direction as to project from the saddle-stitch compilation tray 21 (rightward in FIGS. 4A and 4B). A transition is made to the state of FIG. 4C past the state of FIG. 4B. A sheaf of sheets starts to be lifted in the state of FIG. 4B. In the state of FIG. 4C, the folding knife 25 goes to such a position that the sheaf of sheets is pressed by the first folding rollers 26; first-stage folding is performed on the sheaf of sheets. Then, the motor 74 is rotated further. Because of the rotation of the cranks 72, the folding knife 25 starts to be retreated as shown in FIG. 4D. When the folding knife 25 has retreated to an escape position of FIG. 4E, a state of the encoder 75 is detected by the sensor 76. The controller 100 stops the operation of the motor 74 to render the folding knife 25 in a standby state until the next folding processing.

Next, the rotary cutter unit 30 will be described.

Figure 5A:
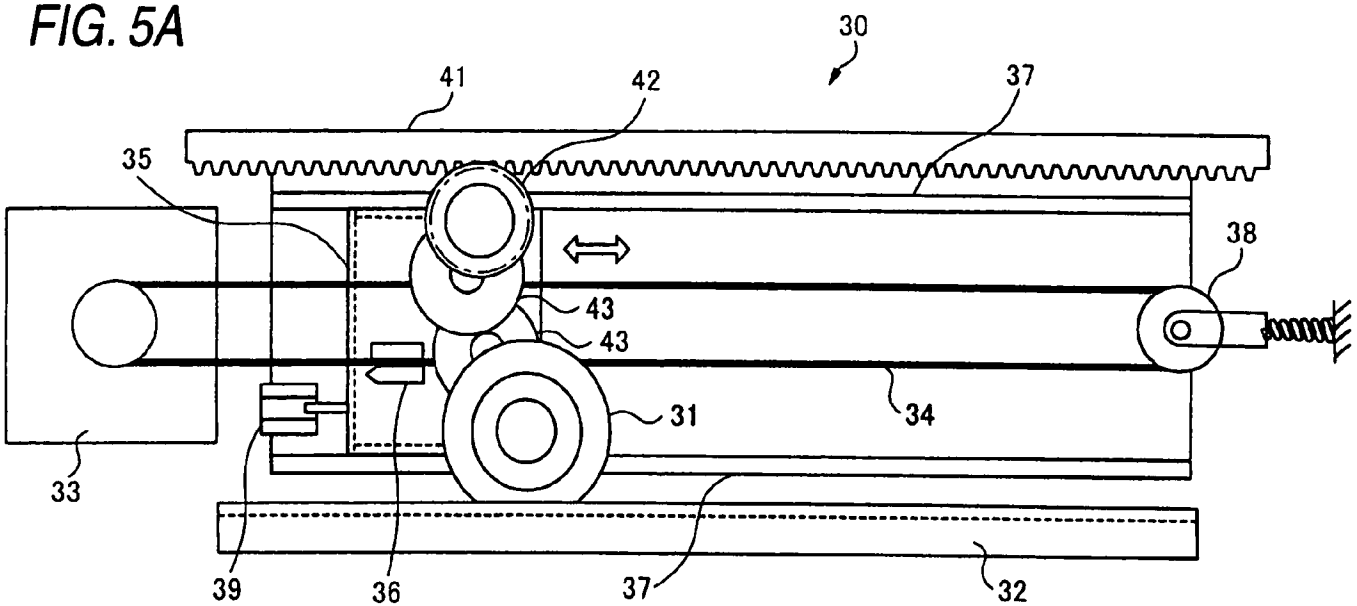
FIGS. 5A and 5B illustrate the configuration of a rotary cutter unit according to the embodiment.
Figure 5B:
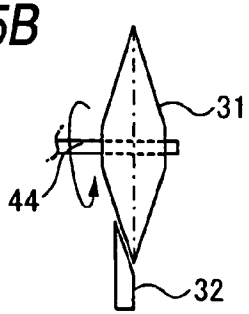

FIGS. 5A and 5B illustrate the configuration of the rotary cutter unit 30 according to the embodiment. FIG. 5A is a side view showing the configuration of the rotary cutter unit 30, and FIG. 5B shows blades. As shown in FIG. 5A, the rotary cutter unit 30 according to the embodiment is equipped with a circular blade 31 for cutting a sheaf of sheets while rotating and moving parallel with the sheet surfaces (i.e., in a horizontal direction); a fixed blade 32 opposed to the circular blade 31 and extending perpendicularly to the transport direction of recorded sheets; a motor 33 such as a stepping motor as a driving source for moving the circular blade 31; a belt 34 that is rotated by the motor 33; a carrier 35 that is moved while holding the circular blade 31 etc.; a belt fixing member 36 by which the carrier 35 is fixed to the belt 34; a guide shaft 37 for guiding the carrier 35 when it moves; and a tensioner 38 for pulling the belt 34 by means of a spring or the like to give constant tension to the belt 34. The rotary cutter unit 30 is also equipped with a home position sensor 39 that serves to determine a standby position of the circular blade 31.

The rotary cutter unit 30 is also equipped, as a mechanism for rotating the circular blade 31, with a rack 41 that extends in the moving direction of the circular blade 31. The carrier 35 is provided with a pinion 42 that is disposed opposite to the rack 41 and is rotated as the carrier 35 moves and one or plural (two in FIG. 5A) gears 43 that is in mesh with the gear teeth of the pinion 42 and transmits rotational force to the circular blade 31 with a prescribed speed ratio.

The circular blade 31 is in contact with the fixed blade 32 in, for example, a manner shown in FIG. 5B. The circular blade 31 is rotated by a cantilever shaft 44. Although the circular blade 31 that is moved parallel with sheet surfaces (i.e., in a horizontal direction) is used rather than a conventional guillotine-type cutting blade, the second folding rollers 27, for example, can be disposed on the side opposite to the cantilever shaft 44 and close to the circular blade 31 because the cantilever structure having the cantilever shaft 44 is employed for the circular blade 31.

Next, the operation of the rotary cutter unit 30 will be described with reference to FIG. 5. Folding is started by the first folding rollers 26 and the fold is sharpened by the second folding rollers 27 (see FIG. 1). Under the control of the controller 100, the cutting portion of a resulting sheaf of sheets is transported to the cutting position of the rotary cutter unit 30 by rotation of the second folding rollers 27. While the sheaf of sheets is transported to the cutting position, the circular blade 31 of the rotary cutter unit 30 is in escape at the end in the direction perpendicular to the sheet transport direction, i.e., at such a position as not to obstruct the transport of the sheaf of sheets (e.g., the home position).

Then, the motor 33 is rotated on the basis of an instruction from the controller 100 in a state that the sheaf of sheets is fixed by the second folding rollers 27. The belt 34 is rotated by the rotation of the motor 33, whereby the carrier 35 is moved in the horizontal direction, that is, in the direction perpendicular to the sheet transport direction. As the carrier 35 is moved, the circular blade 31 is moved in the horizontal direction and the pinion 42, which is also moved in the horizontal direction, is rotated by the rack 41. As a result, the circular blade 31 is rotated via the gears 43. That is, as the motor 33 rotates, the circular blade 31 is moved in the horizontal direction while being rotated.

After touching the end of the sheaf of sheets that is fixed by the second folding rollers 27, the circular blade 31 continues to be moved in the horizontal direction, that is, in the direction perpendicular to the sheet transport direction, whereby the sheaf of sheets is cut by the circular blade 31 and the fixed blade 32. That is, the circular blade 31 as the moving blade continues to be pressed against the sheaf of sheets starting from its one end in the direction perpendicular to the sheet transport direction, whereby the sheaf of sheets is cut in the direction perpendicular to the sheet transport direction. At a prescribed instant after completion of the cutting of the sheaf of sheets by the movement of the circular blade 31 in the one, horizontal direction, the rotation direction of the motor 33 is reversed on the basis of a signal from the controller 100. The circular blade 31 is moved in the opposite, horizontal direction and is stopped upon reaching the initial standby position. The circular blade 31 prepares for the next cutting operation.

As described above, in the rotary cutter unit 30 in which a sheaf of sheets is cut by the circular blade 31 that is moved in the horizontal direction, the height of the unit can be made much smaller than in conventional guillotine-type ones. A height of about 440 mm, for example, is needed in conventional slide-type cutting devices because of a long cutting stroke of the blade. In contrast, the height of the rotary cutter unit 30 according to this embodiment can be made as small as about 140 mm, for example. This relaxes the space-related limitations and makes it possible to, for example, dispose the rotary cutter unit 30 over the saddle-stitch compilation tray 21.

Further, because of the use of the circular blade 31 that is moved parallel with sheet surfaces, the starting current and the drive current of the rotary cutter unit 30 according to this embodiment can be made smaller than those of conventional slide-type cutting devices. For example, the starting current and the drive current can be made equal to about 7.5 A and 2.5 A, respectively in the rotary cutter unit 30 according to this embodiment, whereas they are about 12.5 A and 5 A in conventional slide-type cutting devices.

Next, the cutting operation of the rotary cutter unit 30 which is an important component in this embodiment will be described.

FIGS. 6A-6E show an ordinary cutting operation. In the ordinary operation, when a folded sheaf of sheets (i.e., a booklet) is input, the circular blade 31 is in a standby state at the home position that is determined by the home position sensor 39 shown in FIG. 5A (see FIG. 6A). When the folded sheaf of sheets has been fixed at the cutting position by the second folding rollers 27 shown in FIG. 1, rotation of the motor 33 (see FIG. 5) is started. The circular blade 31 is moved (i.e., slid) while being rotated and the sheaf of sheets is cut between the circular blade 31 and the fixed blade 32 as the lower blade (see FIG. 6B). The controller 100 (see FIG. 1), which is counting the number of steps of the motor 33, recognizes, on the basis of a step count, that the circular blade 31 has reached the end position, whereupon the controller 100 stops the rotation of the motor 33. The controller 100 thereafter waits for ejection of a resulting book (see FIG. 6C). After a book has been ejected completely, the controller 100 rotates the motor 33 opposite to the direction of the cutting operation and thereby returns the circular blade 31 to the home position (see FIG. 6D). The circular blade 31 is thereafter kept in a standby state and waits for input of the next (i.e., second) folded sheaf of sheets (see FIG. 6E). The above operation is repeated by a necessary number of times of cutting, that is, by a necessary number of copies.

Figure 6A:
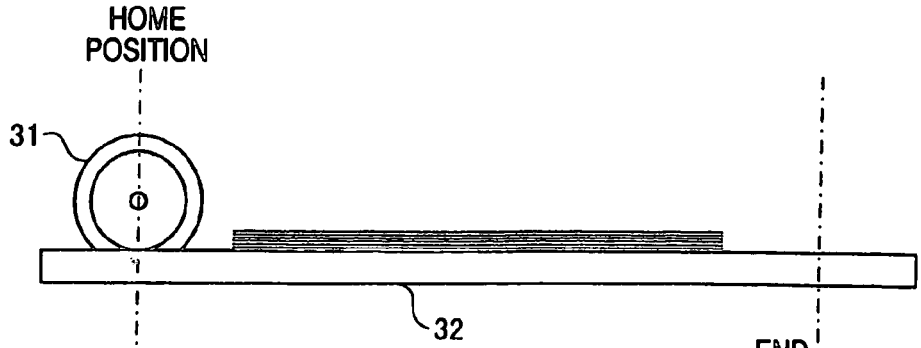
FIGS. 6A-6E show an ordinary cutting operation.
Figure 6B:
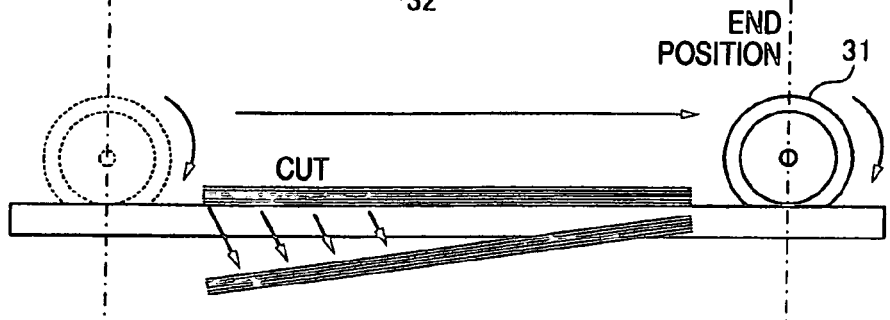
Figure 6C:
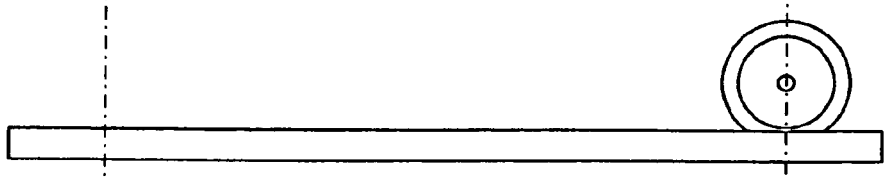
Figure 6D:
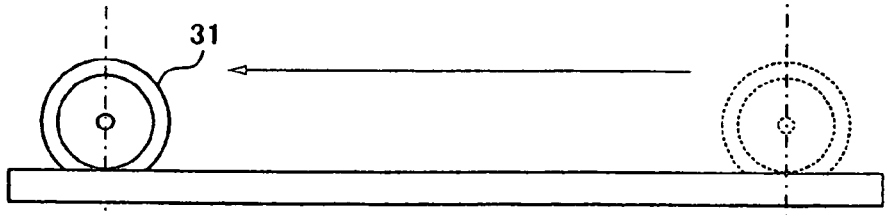
Figure 6E:
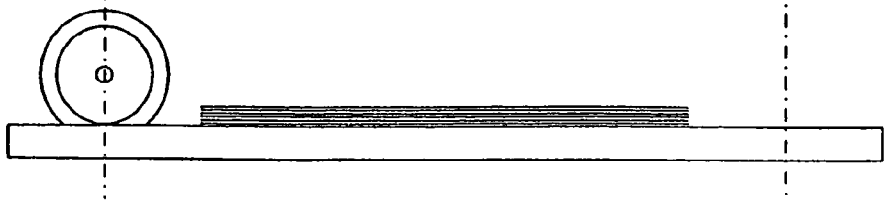
Figure 7A:
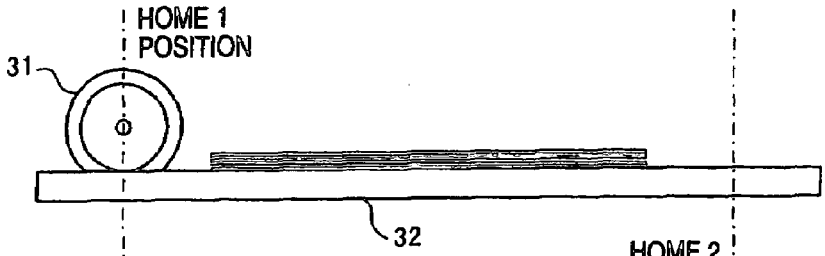
FIGS. 7A-7E illustrate an operation in which cutting is performed in each of a go-movement and a return-movement.
Figure 7B:
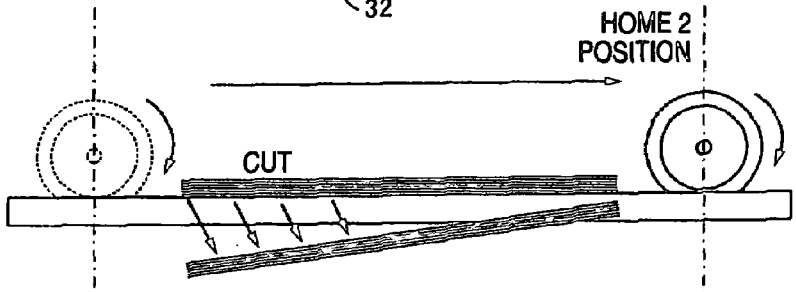
Figure 7C:
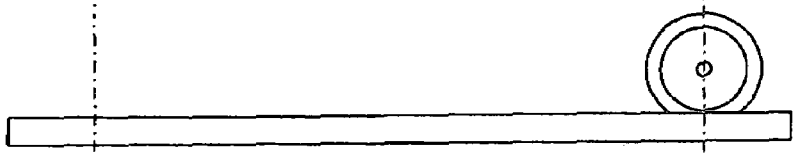
Figure 7D:
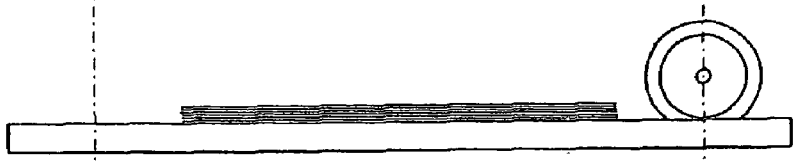
Figure 7E:
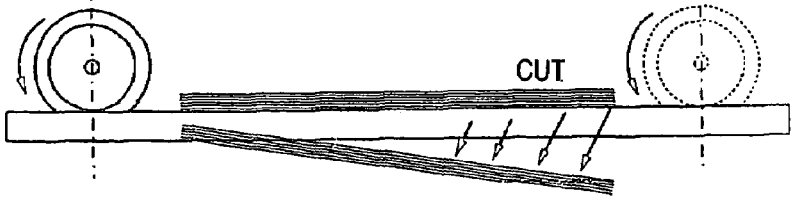

In the returning of FIG. 6D, the circular blade 31 is returned while being rotated in the case where the rotation and the slide movement of the circular blade 31 are linked with each other as shown in FIG. 5A. However, if they are not linked with each other, it is not necessary to rotate the circular blade 31. Not rotating the circular blade 31 when it is returned is superior in terms of reduction in power consumption.

FIGS. 7A-7E illustrate an operation in which cutting is performed in each of a go-movement and a return-movement. First, when a folded sheaf of sheets is input, the circular blade 31 is in a standby state at the home position (i.e., first home position) that is determined by the home position sensor 39 shown in FIG. 5 (see FIG. 7A). When the folded sheaf of sheets has been fixed at the cutting position by the second folding rollers 27, rotation of the motor 33 is started. The circular blade 31 is moved (i.e., slid) rightward in FIG. 7B while being rotated and the sheaf of sheets (first copy) is cut between the circular blade 31 and the fixed blade 32. The controller 100, which is counting the number of steps of the motor 33, recognizes, on the basis of a step count, that the circular blade 31 has reached a second home position, whereupon the controller 100 stops the rotation of the motor 33. Unlike the case of FIG. 6D, the circular blade 31 is not returned immediately after a book has been ejected but is kept in a standby state at the second home position (see FIG. 7C). The circular blade 31 waits for input of a second folded sheaf of sheets (see FIG. 7D). When a second folded sheaf of sheets has been input, the controller 100 rotates the motor 33 in the reverse direction and thereby rotates the circular blade 31 opposite to the rotation direction of the cutting of the first sheaf of sheets and slides the circular blade 31 in the direction (i.e., leftward in FIG. 7E) opposite to the direction of the cutting of the first sheaf of sheets, whereby the second sheaf of sheets is cut between the circular blade 31 and the fixed blade 32. The circular blade 31 is thereafter stopped at the home position (i.e., first home position) that is determined by the home position sensor 39 and waits for input of the next folded sheaf of sheets. Performing cutting in each of a go-movement and a return-movement in the above manner makes it possible to omit the time that is consumed only for a return movement as shown in FIG. 6D as well as its power consumption.

FIGS. 8A-8E and FIGS. 9A-9D show cutting operations for a small-size book. More specifically, FIGS. 8A-8E show a center-registration cutting operation and FIGS. 9A-9D show a side-registration cutting operation. In image forming apparatus, two kinds of registration methods are employed: side registration in which only one of an IN-side end and an OUT-side end of the apparatus is employed as an image formation reference position and center registration in which the center (in the direction perpendicular to the sheet transport direction) of the apparatus is employed as an image formation reference position and the length is distributed to the two sides. In this embodiment in which a sheaf of sheets is cut by sliding the circular blade 31 perpendicularly to the sheet transport direction, variations may occur in the start position and the end position of cutting particularly in forming a small-size book. Cutting operations corresponding to those different registration methods, respectively, will be described below.

A center-registration cutting operation for forming a small-size book is as follows. After starting to drive the motor 33, while counting the number of steps the controller 100 moves the circular blade 31 from the home position that is determined by the home position sensor 39 (see FIG. 5) to a job start position where to start actual cutting on a small-size sheaf of sheets (see FIG. 8A). The controller 100 waits for input of a first sheaf of sheets (see FIG. 8B). Alternatively, the circular blade 31 may be moved to the job start position at the same time as inputting of a small-size sheaf of sheets. When the sheaf of sheets has been fixed to the cutting position by the second folding rollers 27, rotation of the motor 33 is started. The circular blade 31 is moved (i.e., slid) rightward in FIG. 8C while being rotated, whereby the first sheaf of sheets is cut between the circular blade 31 and the fixed blade 32. During that course, the controller 100 recognizes, on the basis of a count of steps of the motor 33, that the circular blade 31 has reached a job end position past the sheet cutting range and stops the rotation of the motor 33. Then, the controller 100 waits for ejection of a book (see FIG. 8D). After ejection of a book, the controller 100 rotates the motor 33 in the reverse direction, whereby the circular blade 31 is moved to the job start position and stopped there (see FIG. 8E). In the case of the cutting operation of FIGS. 8A-8E, the job start position and the job end position depend on the sheet size. In view of this, the circular blade 31 is positioned at each of those positions by the controller 100's performing a step control on the motor 33 on the basis of a sheet size recognition result.

A side-registration cutting operation for forming a small-size book is as follows. The circular blade 31 waits at the home position until input of a first sheaf of sheets (see FIG. 9A). After input of a sheaf of sheets, the controller 100 drives the motor 33, whereby the small-size sheaf of sheets is cut by the fixed blade 32 and the circular blade 31 that is slid while being rotated (see FIG. 9B). After cutting the sheaf of sheets, the controller 100 recognizes, through the step control on the motor 33, that the circular blade 31 has reached a job end position and stops the driving of the motor 33. Then, the controller 100 waits for ejection of a first book (see FIG. 9C). After ejection of a book, the controller 100 rotates the motor 33 in the reverse direction, whereby the circular blade 31 is returned to the home position that is determined by the home position sensor 39 (see FIG. 9D).

As described above, in cutting a small-size sheaf of sheets, the movement range of the circular blade 31 is changed and the movement distance (i.e., stroke) of the circular blade 31 is thereby shortened, which makes it possible to reduce the time taken to perform cutting as well as its power consumption.

Figure 8A:
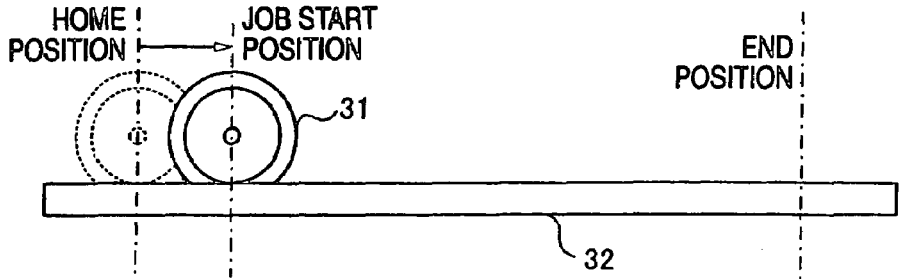
FIGS. 8A-8E show a center-registration cutting operation.
Figure 8B:
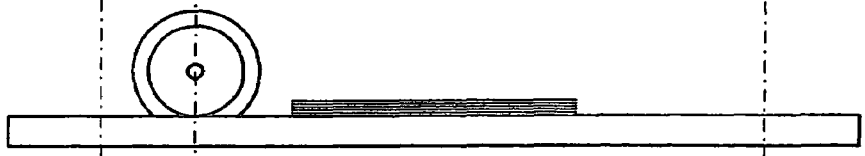
Figure 8C:
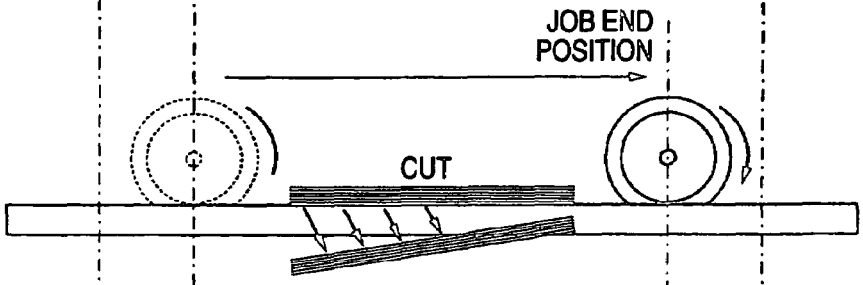
Figure 8D:
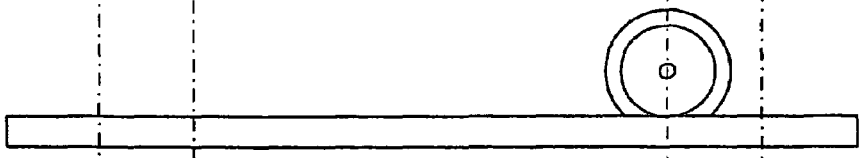
Figure 8E:
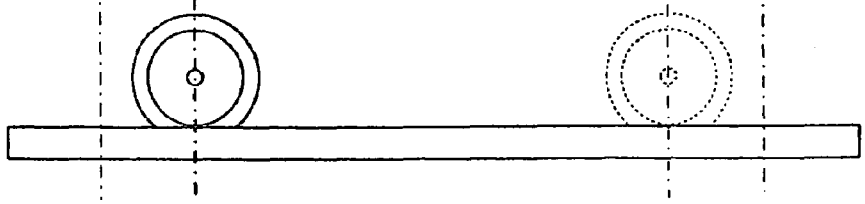
Figures 9A, 9B, 9C, 9D:
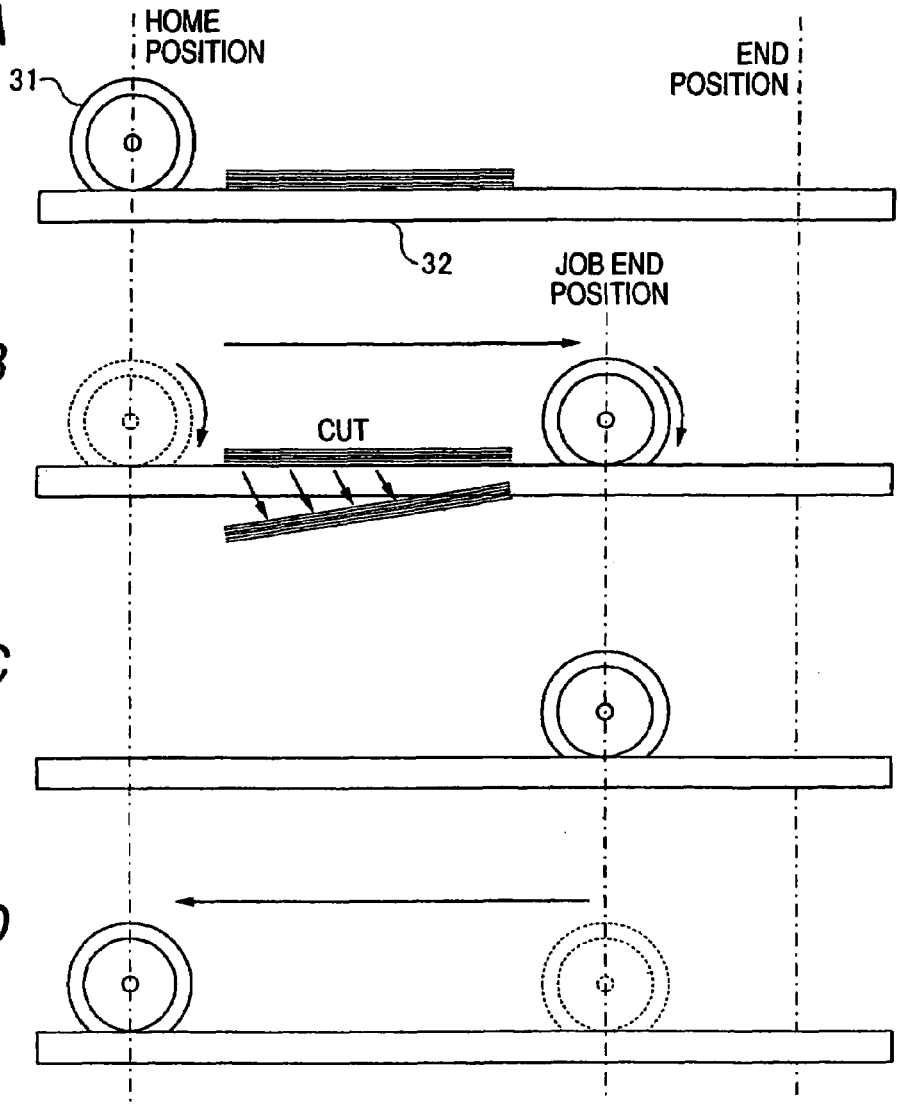
FIGS. 9A-9D show a side-registration cutting operation.
Figures 10A, 10B, 10C, 10D, 10E:
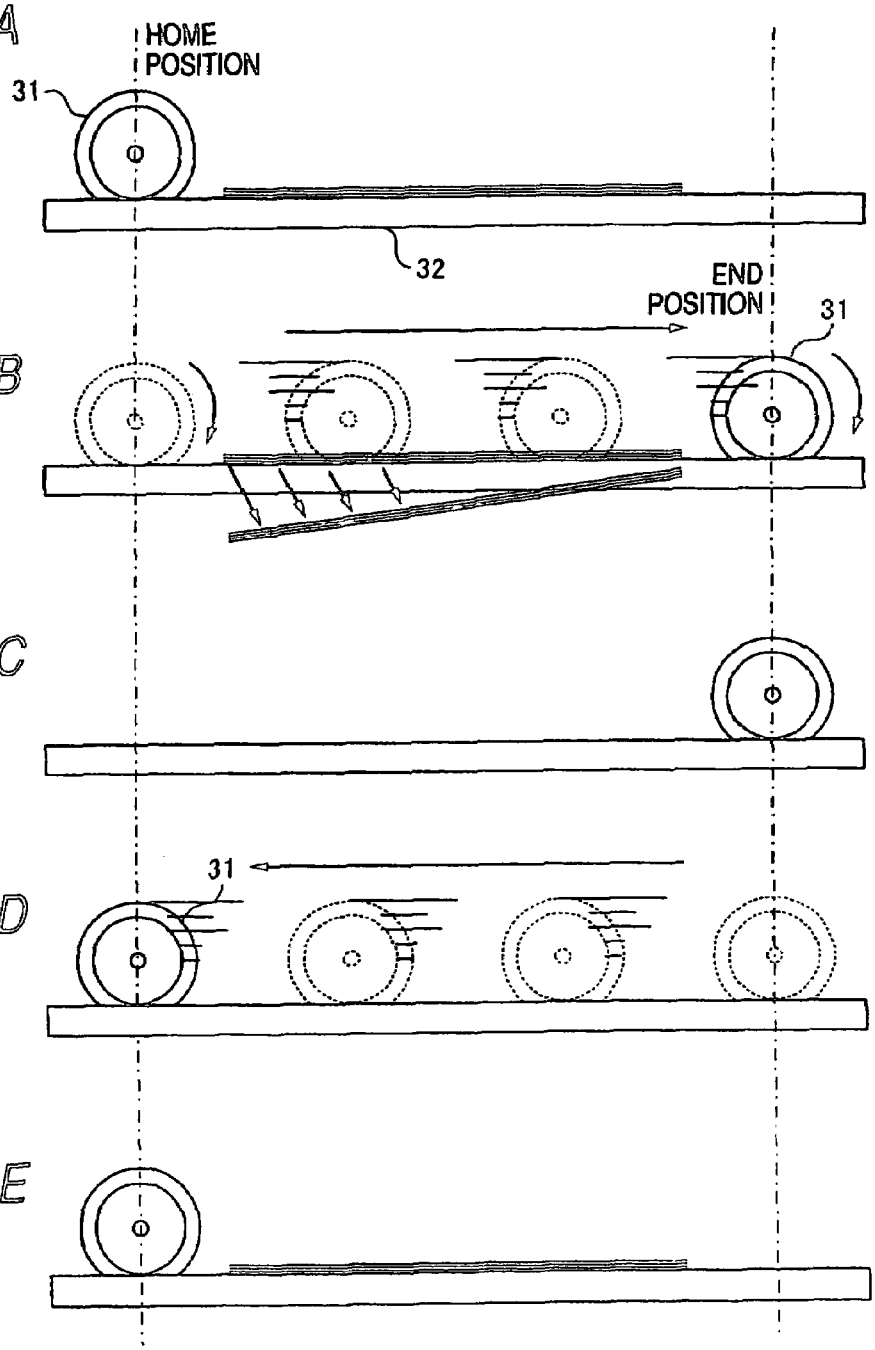
FIGS. 10A-10E show a cutting operation that is performed at a high moving speed.
Figure 11A:
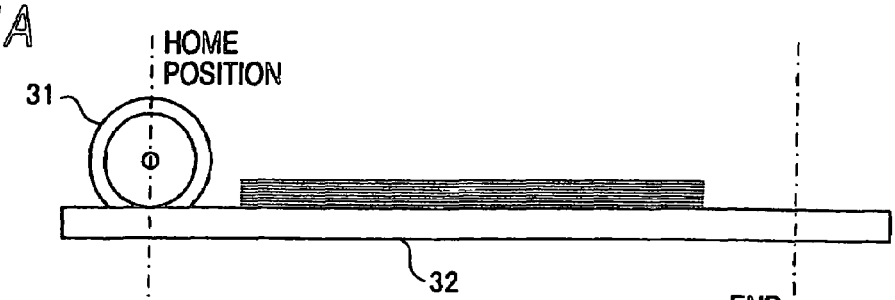
FIGS. 11A-11E show a cutting operation that is performed at a low moving speed.
Figure 11B:
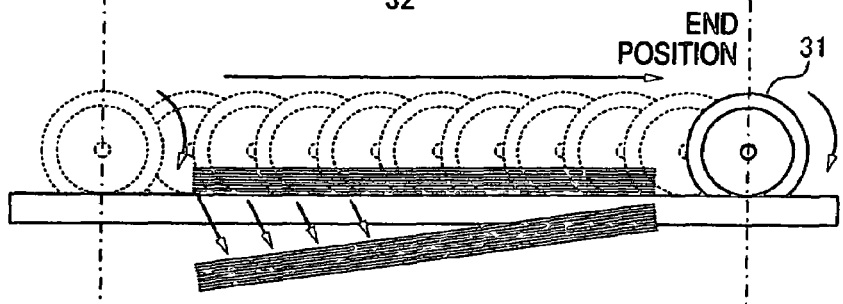
Figure 11C:
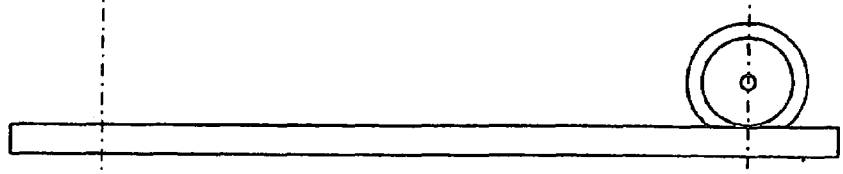
Figure 11D:
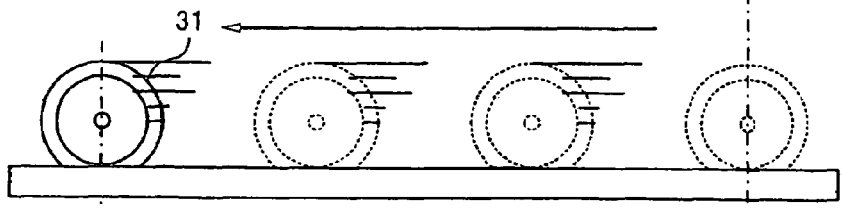
Figure 11E:
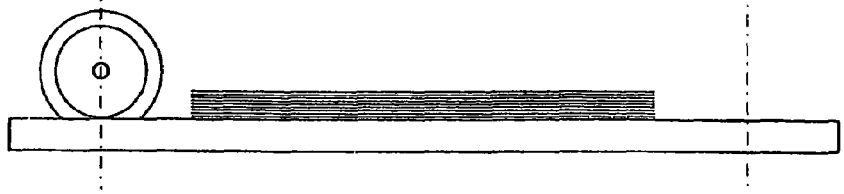

In the return movement of FIG. 8E or 9D, the circular blade 31 may be rotated in either direction or its rotation may be stopped. Or the apparatus 10 may be configured so as to be able to perform cutting in a return movement as described with reference to FIGS. 7A-7E.

Next, a description will be made of cutting operations that are performed at different moving speeds of the circular blade 31 (the moving speed is one of the cutting conditions).

FIGS. 10A-10E show a cutting operation that is performed at a high moving speed. When a book is to be formed by binding a small number of sheets or binding soft sheets, it is possible to cut a sheaf of sheets quickly. In this case, first, the controller 100 waits for input of a first sheaf of sheets with the circular blade 31 located at the home position (see FIG. 10A). After input of a sheaf of sheets, the controller 100 drives the motor 33, whereby the sheaf of sheets is cut as the circular blade 31 is slid while being rotated (see FIG. 10B). The sheaf of sheets is cut quickly by setting the rotation speed of the motor 33 high. Then, the controller 100 waits for ejection of a resulting book with the circular blade 31 located at the end position (see FIG. 1C). After ejection of a book, the circular blade 31 is returned quickly (see FIG. 10D). Then, the controller 100 waits for input of the next (i.e., second) sheaf of sheets with the circular blade 31 located at the home position (see FIG. 10E). In this manner, where a thin book or a book of soft sheets is to be formed, stronger force is not needed for cutting and a sheaf of sheets can be cut satisfactorily even at a high moving speed. Increasing the moving speed makes it possible to shorten the cutting time.

FIGS. 11A-11E show a cutting operation that is performed at a low moving speed. When a book having a large number of sheets (i.e., a thick book) or a book of thick or hard sheets is to be formed, it is preferable to cut a sheaf of sheets slowly. First, the controller 100 waits for input of a first sheaf of sheets with the circular blade 31 located at the home position (see FIG. 1A). After input of a sheaf of sheets, the controller 100 drives the motor 33, whereby the sheaf of sheets is cut as the circular blade 31 is slid while being rotated (see FIG. 11B). The sheaf of sheets is cut slowly by setting the rotation speed of the motor 33 low and thereby moving the circular blade 31 slowly. Then, the controller 100 waits for ejection of a resulting book with the circular blade 31 located at the end position (see FIG. 11C). After ejection of a book, the circular blade 31 is returned quickly (see FIG. 11D). Then, the controller 100 waits for input of the next (i.e., second) sheaf of sheets with the circular blade 31 located at the home position (see FIG. 11E). Where a sheaf of sheets is thick or each sheet is thick or hard, stronger force is needed for cutting. However, even in such a case, cutting a sheaf of sheets slowly makes it possible to reduce the cutting force and hence the power consumption. If a sheaf of thick sheets is cut at a high speed, a resulting cut surface may become rough; slow cutting makes it possible to keep the quality of a cut surface high.

Next, a description will be made of cutting operations that are performed when a sufficient amount of power is available and is not available, respectively. As far as only the post-processing apparatus 10 is concerned, when another module is in operation, for example, a stapling operation by the saddle-stitch stapler 24 or the end-stapling stapler 17 or a punching operation (not shown) is being performed, a sufficient amount of power may not be available. Where power is supplied from the main body of the image forming apparatus 7, whether a sufficient amount of power is available depends on the power consumption state of the main body of the image forming apparatus 7. In this embodiment, if a sufficient amount of power is available, the cutting speed is set high and a sheaf of sheets is cut quickly. Also, the circular blade 31 is returned quickly. This makes it possible to shorten the time that is consumed by cutting and to thereby increase the productivity. On the other hand, if a sufficient amount of power is not available, the cutting speed is set low and a sheaf of sheets is cut slowly. Also, the circular blade 31 is returned slowly. This makes it possible to reduce the power consumption of cutting and hence to complete a cutting operation without causing any problem even if a sufficient amount of power is not available.

Next, a description will be made of a control method of a rotational cutting operation using the circular blade 31 according to the embodiment.

Figure 12:
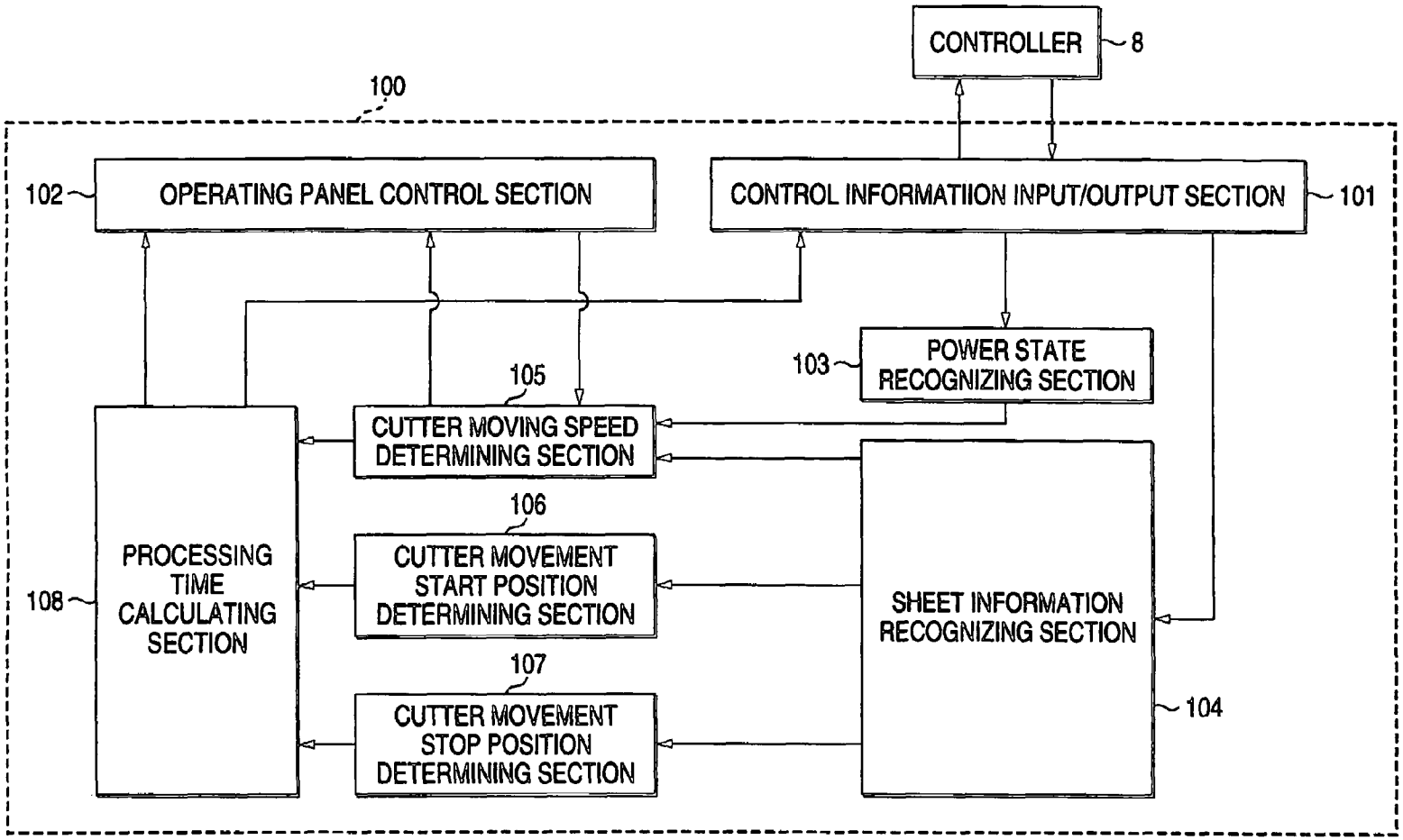
FIG. 12 is a functional block diagram for a cutting operation of a controller.

FIG. 12 is a functional block diagram for a cutting operation of the controller 100. The controller 100 of the sheet processing apparatus 10 is equipped with a control information input/output section 101 for sending and receiving various kinds of control information to and from the controller 8 of the image forming apparatus 7; an operating panel control section 102 for controlling an operating panel on which a message to a user (operator) is displayed and through which an instruction of a user is input; a power state recognizing section 103 for recognizing power states of the sheet processing apparatus 10 and the image forming apparatus 7; a sheet information recognizing section 104 for recognizing various kinds of sheet-related information such as the number and kind of sheets on which a cutting operation is to be performed and whether side registration or center registration is employed; a cutter moving speed determining section 105 for determining rotation and moving speeds of the circular blade 31 on the basis of power states, sheet information, a manipulation-input instruction of a user, and other information; a cutter movement start position determining section 106 for determining a cutting start position (i.e., a job start position or the like) of the circular blade 31; a cutter movement stop position determining section 107 for determining a position of the circular blade 31 where cutting should be finished (i.e., a job end position or the like); and a processing time calculating section 108 for calculating a processing time needed for cutting on the basis of a cutter moving speed and a cutter movement distance. Although in this embodiment the operating panel control section 102 controls the operating panel (not shown) of the sheet processing apparatus 10, the operating panel control section 102 may be configured so as to control an operating panel (not shown) provided on the main body of the image forming apparatus 7 directly or indirectly via the control information input/output section 101.

Figure 13:
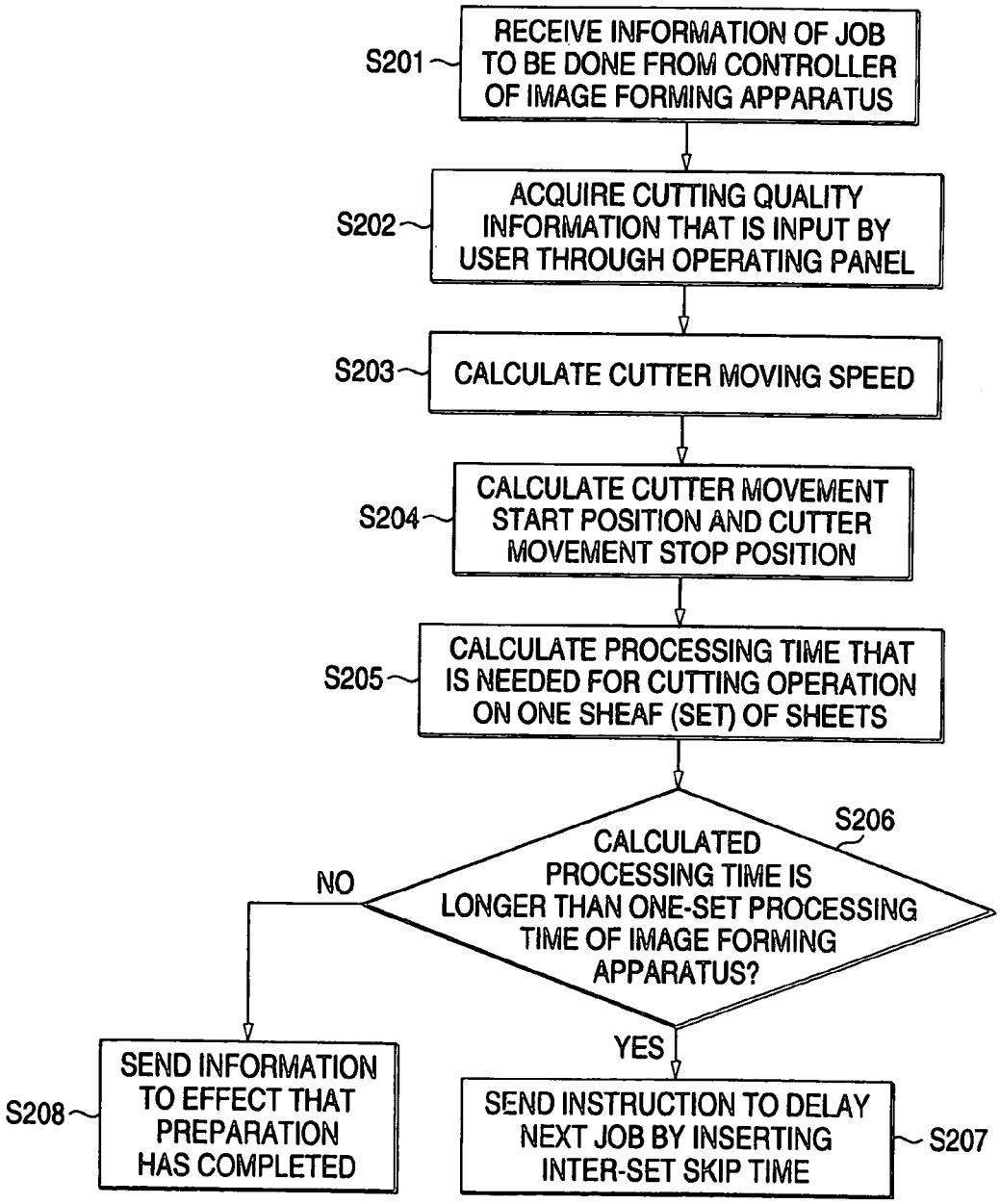
FIG. 13 is a flowchart of the entire process that is executed by the controller.

FIG. 13 is a flowchart of the entire process that is executed by the controller 100. At step S201, the control information input/output section 101 receives, from the controller 8 of the image forming apparatus 7, job information such as the number of sheets, a kind of sheet (ordinary sheet, thick sheet-1, or thick sheet-2), a sheet size, and a registration method (side registration or center registration). At step S202, the operating panel control section 102 acquires various kinds of cutting quality information such as a cutting quality choice (quality priority or processing speed priority) of a user that has been input through the operating panel (not shown). At step S203, the cutter moving speed determining section 105 determines a moving speed of the circular blade 31 on the basis of the above information according to, for example, a process described later. At step S204, the cutter movement start position determining section 106 and the cutter movement stop position determining section 107 determine a cutter movement start position and a cutter movement stop position of the circular blade 31 according to, for example, a process described later.

At step S205, the processing time calculating section 108 calculates a processing time of a cutting operation on the basis of the information determined at steps S203 and S204. For example, a processing time of one cutting operation can be calculated according to the following equation:

(processing time of one cutting operation)=(cutter movement distance)/(cutter moving speed during cutting)+(cutter movement distance)/(return cutter moving speed)+(sheets transport processing time).

At step S206, it is judged whether the calculated processing time is longer than a processing time of one sheaf (set) of sheets in the main body of the image forming apparatus 7. If the calculated processing time is longer, at step S207 the control information input/output section 101 sends the controller 8 an instruction to delay the next job by inserting an inter-set skip time. If the calculated processing time is not longer, at step S208 the control information input/output section 101 sends the controller 8 information to the effect that a preparation for a cutting operation has completed. The main body of the image forming apparatus 7 may be configured so as to display a message such as "The processing is taking a long time. Please wait for a while." on the operating panel (not shown) if the inter-set skip time is too long.

Figure 14:
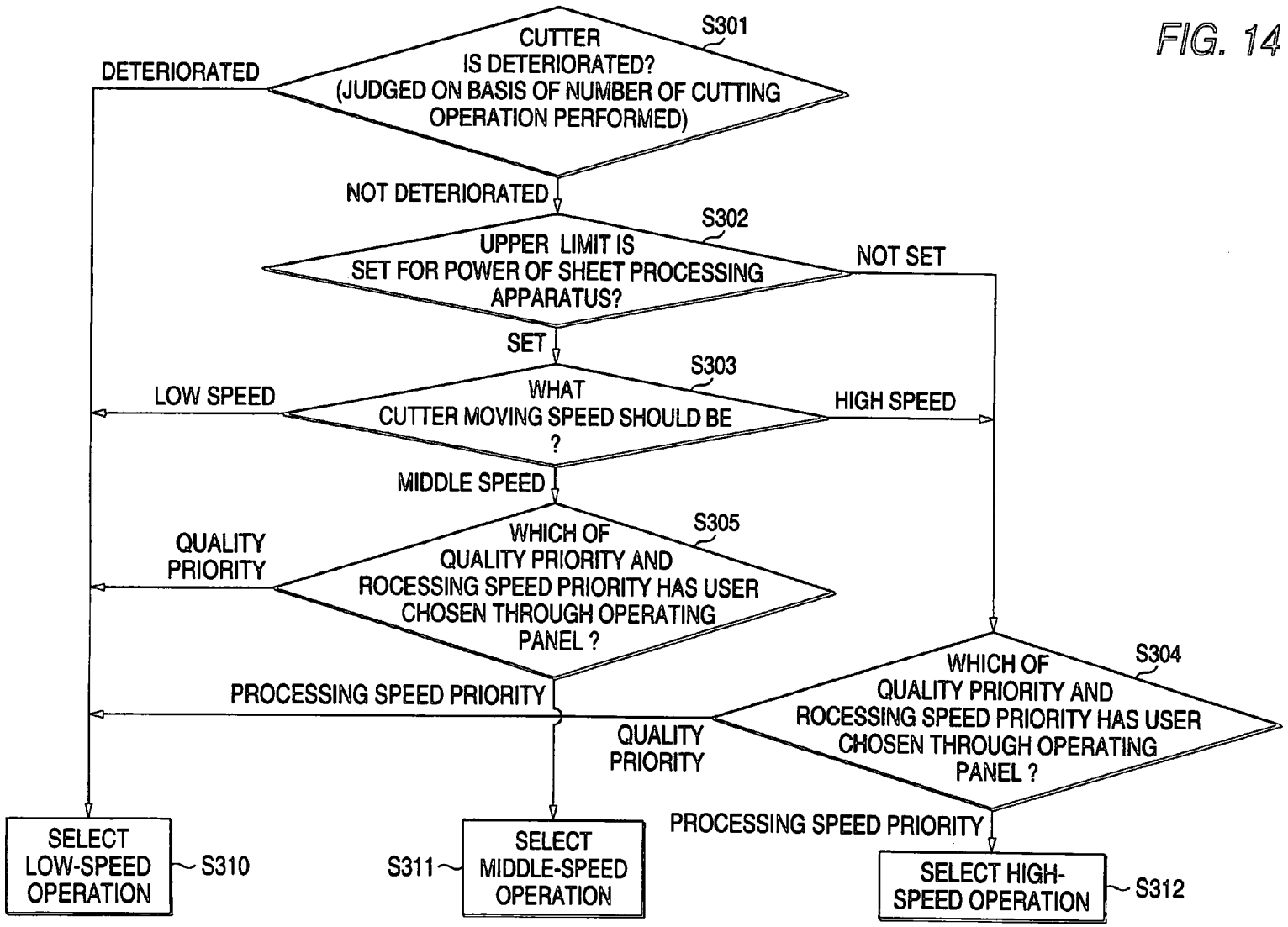
FIG. 14 is a flowchart showing a method for determining a moving speed of a circular blade.

FIG. 14 is a flowchart showing a method for determining a moving speed of the circular blade 31 at step S203. First, at step S301, the cutter moving speed determining section 105 recognizes a deterioration state of the cutter (i.e., the circular blade 31 and the fixed blade 32). For example, this is done by storing, in a memory (not shown), the number of cutting operations that have been performed after substitution of a current cutter and judging whether the number of cutting operations exceeds a prescribed threshold value that represents the cutter durability. Naturally, different threshold values may be set for the circular blade 31 and the fixed blade 32. If the number of cutting operations exceeds the prescribed threshold value and hence it is judged that the cutter is deteriorated unacceptably, at step S310, a low-speed operation is selected and a message "Replace the cutting unit" is displayed on the operating panel (not shown).

If it is judged at step S301 that the cutter has not been deteriorated unacceptably, at step S302 it is judged, on the basis of a recognition of the power state recognizing section 103, whether an upper limit is set for the power consumption in the sheet processing apparatus 10 (i.e., a finisher). If an upper limit is set, at step S303 a cutter moving speed is set on the basis of the number and the kind of sheets and other information that have been recognized by the sheet information recognizing section 104. If no power upper limit is set, the operating panel control section 102 judges at step S304 which of quality priority and processing speed priority has been chosen by the user. If the user has chosen quality priority, a low-speed operation is selected at step S310. If the user has chosen processing speed priority, a high-speed operation is selected at step S312.

If a power upper limit is set and it is judged at step S303 that a low-speed operation is preferable, a low-speed operation is selected at step S310. If it is judged at step S303 that a middle-speed operation is preferable, the operating panel control section 102 judges at step S305 which of quality priority and processing speed priority has been chosen by the user. If the user has chosen quality priority, a low-speed operation is selected at step S310. If the user has chosen processing speed priority, a middle-speed operation is selected at step S311. If it is judged at step S303 that a high-speed operation is preferable, it is judged at step S304 which of quality priority and processing speed priority has been chosen by the user. If the user has chosen quality priority, a low-speed operation is selected at step S310. If the user has chosen processing speed priority, a high-speed operation is selected at step S312.

FIG. 15 shows exemplary criteria for the judgment of step S303, that is, a relationship between the cutter moving speed and the number and the kind of sheets in a case that a power upper limit is set. In this example, the number of sheets to be cut is classified into 2 to 15 and the kind of sheets is classified into an ordinary sheet (64-128 gsm), a thick sheet-1 (129-162 gsm), and a thick sheet-2 (163-220 gsm). "High speed," "middle speed, " and "low speed" in the table mean moving speeds of the circular blade 31 and depend on the cutting thickness. If the sheaf of sheets is too thick, the judgment result should be "book formation impossible." Numerical values in parentheses are total cutting thickness values. The cutter moving speed of a return movement is always set to the high speed. Setting the moving speed of the circular blade 31 in the above manner, that is, finely by combining the number and the kind of sheets, makes it possible to perform a cutting operation properly even in the case where an upper power limit is set. Since the circular blade 31 is moved and rotated by the same motor 33 as shown in FIG. 5, a cutter rotation speed is determined automatically by determining a cutter moving speed. It is naturally possible to provide separate driving mechanisms for the movement and the rotation and control their speeds individually. Further, although in the example of FIG. 15 the moving speed is set in three levels, it may be set in two levels or, conversely, it may be set more finely, that is, in four or more levels.

Next, a description will be made of a method for calculating a cutter movement start position and a cutter movement stop position to determine a movement range of the circular blade 31 (step S204 in FIG. 13).

Figure 16:
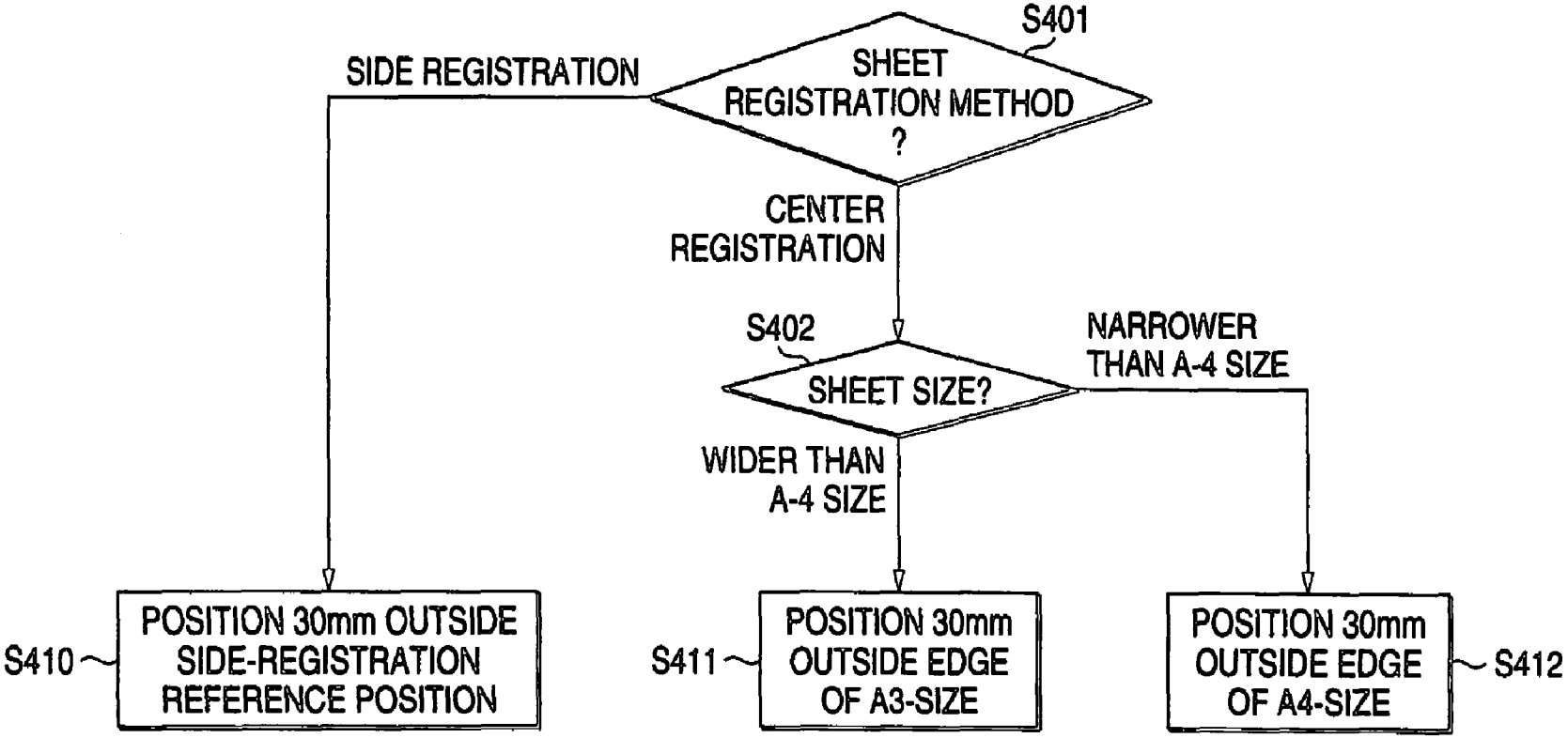
FIG. 16 is a flowchart of a method for calculating a cutter movement start position in the cutter movement start position determining section.

FIG. 16 is a flow chart of a method for calculating a cutter movement start position in the cutter movement start position determining section 106. In the cutter movement start position determining section 106, first, at step S401, a sheet registration method of image formation in the image forming apparatus 7 is recognized via the sheet information recognizing section 104. If side registration is employed, at step S410 a position that is 30 mm outside a side-registration reference position is determined as a cutter movement start position. In many cases, this cutter movement start position coincides with the home position that is determined by the home position sensor 39 (see FIG. 5).

If it is judged at step S401 that center registration is employed, it is judged at step S402 whether the sheet size that is recognized via the sheet information recognizing section 104 is greater than the A4-size (longitudinal length: 297 mm), for example, in the direction perpendicular to the sheet running direction. If the sheet size is greater than the A4-size, at step S411 a position that is 30 mm outside the edge of the A3-size (i.e., a position that is distant from the center by (297/2+30) mm), for example, is determined as a cutter movement start position. If the sheet size is smaller than the A4-size, at step S402 a position that is 30 mm outside the edge of the A4-size (i.e., a position that is distant from the center by (210/2+30) mm), for example, is determined at step S412 as a cutter movement start position. The reason why the A-series sizes are used as references is that they are most frequently used by users. Other arbitrary values may also be used. Further, a cutter movement start position may be determined more finely.

Figure 17:
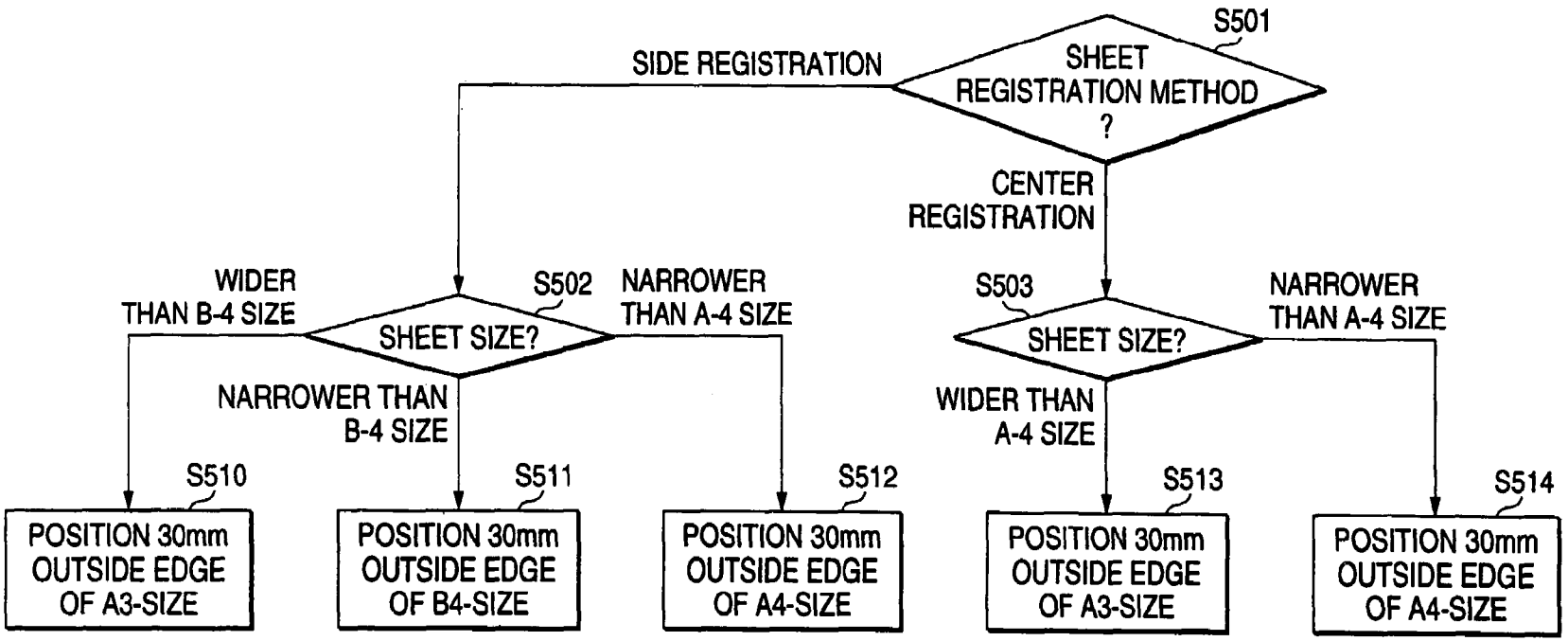
FIG. 17 is a flowchart of a method for calculating a cutter movement stop position in the cutter movement stop position determining section.
Figure 18:
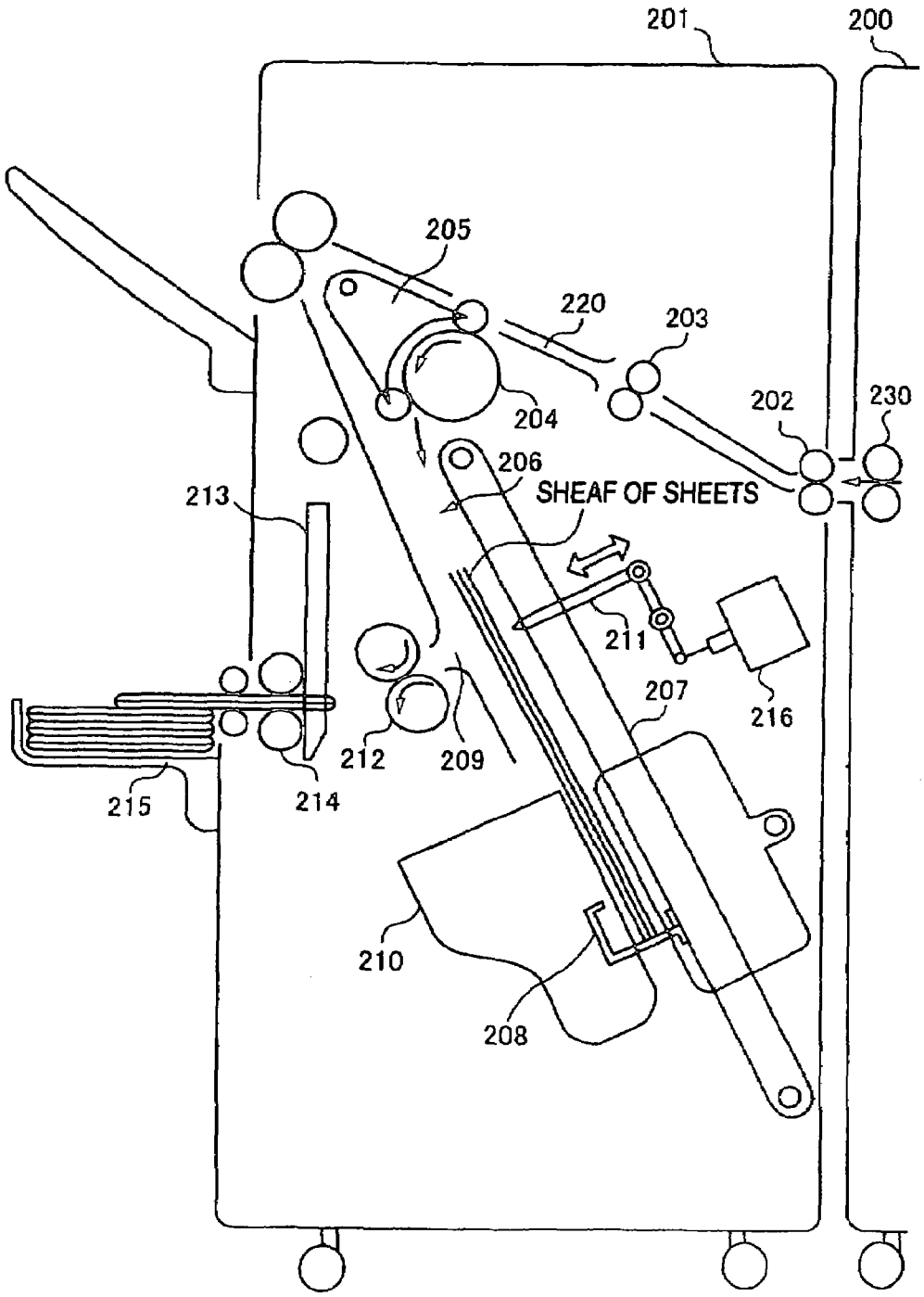
FIG. 18 shows a conventional sheet post-processing apparatus.

FIG. 17 is a flowchart of a method for calculating a cutter movement stop position in the cutter movement stop position determining section 107. In the cutter movement start position determining section 107, first, at step S501, a sheet registration method of image formation in the image forming apparatus 7 is recognized via the sheet information recognizing section 104. If side registration is employed, at step S502 a sheet size is recognized via the sheet information recognizing section 104. If the sheet size is greater than the B4-size (shorter-side length: 257 mm), at step S510 a position that is 30 mm outside the edge of the A3 size (i.e., a position that is distant from the center by (297+30) mm) is determined as a cutter movement stop position. If the sheet size is smaller than the B4-size, at step S511 a position that is 30 mm outside the edge of the B4 size (i.e., a position that is distant from the center by (257+30) mm) is determined as a cutter movement stop position. If the sheet size is smaller than the A4-size (lateral length: 210 mm), at step S512 a position that is 30 mm outside the edge of the A4 size (i.e., a position that is distant from the center by (210+30) mm) is determined as a cutter movement stop position.

If it is judged at step S501 that center registration is employed, at S503 a sheet size is recognized via the sheet information recognizing section 104. If the sheet size is greater than the A4-size (210 mm), at step S513 a position that is 30 mm outside the edge of the A3-size (i.e., a position that is distant from the center by (297/2+30) mm) is determined as a cutter movement stop position. If the sheet size is smaller than the A4-size, at step S514 a position that is 30 mm outside the edge of the A4-size (i.e., a position that is distant from the center by (210/2+30) mm) is determined as a cutter movement stop position.

As described in detail, according to the embodiment, in the sheet processing apparatus in which a sheaf of sheets is cut by the cutter unit (rotary cutter unit 30) having the circular blade that is moved parallel with the sheets while being rotated, a cutting operation can be performed by changing cutting conditions on the basis of various kinds of information such as the number and the kind of sheets, a power state, whether the sheets are of center registration or side registration, and a request from a user. This makes it possible to enhance the cutting function by reducing the power consumption, shortening the cutting time, keeping the cutting quality high, and so forth.

As described above, the invention can reduce the power consumption, shorten the cutting time, and so forth in a sheet processing apparatus having a sheet cutting function.

The entire disclosure of Japanese Patent Application No. 2003-050438 filed on Feb. 27, 2003 including specification, claims, drawings and abstract is incorporated herein by reference in its entirety.

What is claimed is:

1. A sheet processing apparatus for processing sheets on which images have been formed by an image forming apparatus, comprising:

a sheet accepting unit that accepts sheets from the image forming apparatus;

a cutting unit comprising a circular blade that cuts the sheets accepted by the sheet accepting unit with the blade that is moved in a direction perpendicular to a sheet transport direction; and a recognizing unit that identifies at least one of a number and grams per square meter of sheets to be cut in the form of a sheaf, a movement condition of the blade being determined on the basis of at least one of the number and grams per square meter of sheets identified by the recognizing unit, wherein the recognizing unit further identifies a center registration method that positions the cutting unit to a job start position from a home position to cut the sheet, and a side registration method that positions the cutting unit to the home position to cut the sheet;

wherein a starting position of the cutting unit to cut the sheet is controlled according to the identified registration method.

2. The sheet processing apparatus according to claim 1, wherein the movement condition is a moving speed of the blade that is moved parallel with the sheet surfaces.

3. The sheet processing apparatus according to claim 1, wherein the movement condition is a movement range of the blade that is moved parallel with the sheet surfaces.

4. The sheet processing apparatus according to claim 3, wherein the movement range is determined by a movement start position and/or a movement stop position of the blade that is moved parallel with the sheet surfaces.

5. The sheet processing apparatus according to claim 1, wherein the circular blade cuts the sheet while being moved parallel with the sheet surface in a horizontal direction that is perpendicular to the sheet transport direction.

6. The sheet processing apparatus according to claim 1, wherein the center registration method returns the cutting unit from a job end position back to the job start position for a next cutting operation.

* * * * *